US007064301B2

(12) United States Patent
Han et al.

(10) Patent No.: US 7,064,301 B2
(45) Date of Patent: Jun. 20, 2006

(54) ELECTRIC HEATER

(75) Inventors: Incheol Han, Daejeon-si (KR); Kilsang Jang, Daejeon-si (KR); Dosik Min, Cheongju-si (KR); Wonhoe Kim, Cheongju-si (KR)

(73) Assignee: Halla Climate Control Corporation (KR)

( * ) Notice: Subject to any disclaimer, the term of this patent is extended or adjusted under 35 U.S.C. 154(b) by 0 days.

(21) Appl. No.: 11/085,574

(22) Filed: Mar. 22, 2005

(65) Prior Publication Data

US 2005/0205552 A1 Sep. 22, 2005

(30) Foreign Application Priority Data

Mar. 22, 2004 (KR) ..... 10-2004-0019299
Feb. 16, 2005 (KR) ..... 10-2005-0012621
Feb. 23, 2005 (KR) ..... 10-2005-0015099

(51) Int. Cl.
*H05B 3/06* (2006.01)

(52) U.S. Cl. ..... 219/540; 219/536; 219/546; 219/548; 219/202; 219/541; 219/538

(58) Field of Classification Search ..... 219/540–542, 219/536–538, 530, 546, 548, 202
See application file for complete search history.

(56) References Cited

U.S. PATENT DOCUMENTS

| | | | |
|---|---|---|---|
| 5,057,672 | A | 10/1991 | Bohlender et al. |
| 5,256,857 | A | 10/1993 | Curhan et al. |
| 5,854,471 | A | 12/1998 | Tadokoro et al. |
| 6,180,930 | B1 | 1/2001 | Wu |

FOREIGN PATENT DOCUMENTS

| | | | |
|---|---|---|---|
| DE | 44 04 345 | A1 | 8/1994 |
| DE | 201 21 115 | U1 | 4/2003 |
| EP | 0 516 112 | A2 | 12/1992 |
| EP | 1 130 337 | A2 | 9/2001 |
| EP | 1 253 032 | A2 | 10/2002 |
| EP | 1 253 032 | A3 | 10/2002 |
| FR | 2 793 546 | | 11/2000 |
| GB | 2322275 | * | 9/1998 |

OTHER PUBLICATIONS

European Search Report for PCT 05006223.1-2301, Dated Jul. 14, 2005.

* cited by examiner

*Primary Examiner*—Shawntina Fuqua
(74) *Attorney, Agent, or Firm*—Nixon Peabody LLP; Jeffrey L. Costellia

(57) ABSTRACT

The present invention relates to an electric heater, which electrically and mechanically protects heating means from the outside, increases heating value and thermal conductivity by increasing contact efficiency among components, and improves assembly efficiency and productivity. The electric heater includes: a plurality of radiation members, each having a radiation fin and a radiation fin supporting plate surrounding the radiation fin and formed integrally with the radiation fin by brazing; a plurality of flat tubes arranged between the radiation members and having heating means therein for generating heat when electric power is supplied; first and second support frames oppositely arranged at sides of the outermost radiation members for supporting and fixing the radiation members and the flat tubes; and first and second caps for supporting both end portions of the first and second support frames and both end portions of the flat tubes.

19 Claims, 22 Drawing Sheets

Prior Art

ELECTRIC HEATER

BACKGROUND OF THE INVENTION

1. Field of the Invention

The present invention relates to an electric heater, and more particularly, to an electric heater, which electrically and mechanically protects heating means from the outside, which increases heating value and thermal conductivity by increasing contact efficiency among components, and which improves assembly efficiency and productivity.

2. Background of the Related Art

In general, an air conditioning device for a car includes a cooling system for cooling the inside of the car and a heating system for heating the inside of the car.

The cooling system includes a compressor operated by receiving power form an engine and compressing and discharging refrigerant, a condenser for condensing the refrigerant compressed and discharged from the compressor by forced wind blown from a cooling fan, an expansion valve for expanding the refrigerant passing the condenser, and an evaporator for evaporating the refrigerant passing the expansion valve. The refrigerant passing the evaporator is returned to the compressor.

Meanwhile, the heating system thermally exchanges cooling water passing a heater core out of cooling water, which passes the heater core after cooling the engine and is returned to the engine, and air blown by a fan of a blower unit, and discharges the heated air into the car.

In particular, in the heating system, the cooling water flowing around the driven engine must be sufficiently heated.

However, the engine and the cooling water are cooled to sub-zero temperature in the winter season.

Finally, the heating system has a problem in that it cannot provide an initial heating effect after the engine is driven because it takes long time to increase heat of the engine more than a predetermined temperature.

Therefore, recently, an electric heater using a PTC (Positive Temperature Coefficient) element having a constant temperature feature that resistance value is increased according to temperature rise for initial heating of the car has been invented.

The electric heater using the PTC element is arranged near a heater core mounted inside a case of an air conditioning device and directly heats the air, and so, rises the inside temperature of the car from the initial driving of the engine to the normal driving.

FIG. 1 is a sectional view of a conventional electric heater for a car as an example of the electric heater using the PTC element.

As shown in FIG. 1, the electric heater includes corrugated type radiation fins 503 having a predetermined length, upper and lower frames 501 and 502, a plurality of heating bodies 504, an internal web 505, and a wave type spring 506.

A plurality of the radiation fins 503 are arranged between the upper and lower frames 501 and 502 opposed to each other at predetermined intervals.

The heating bodies 504 are interposed between the radiation fins 503, and each of the heating bodies 504 includes metal band pieces 504*a* separated vertically, and a fixing member 504*c* made of insulating material for fixing a PTC element 504*b* between the metal band pieces 504*a*.

The internal web 505 is arranged outside the radiation fins 503 adjacent to the upper and lower frames 501 and 502.

The wave type spring 506 is mounted between the upper frame 501 or the lower frame 502 and the internal web 505.

The radiation fins 503, the upper and lower frames 501 and 502, the heating bodies 504, the internal web 505 and the wave type spring 506 which are put on another are fixed as one assembly by a side frame 507.

Meanwhile, a terminal 508 is connected to an end portion of the metal band piece 504*a* to be connected to a wire, and protrudes outwardly from the side frame 507 to a predetermined length.

Unexplained reference numeral 509 designates a support band firmly fixed on the radiation fin 503.

The conventional electric heater can improve heating performance till the temperature of the engine rises since the initial driving of the engine, but has the following problems.

First, there may occur electric accidents and fires due to electric short if a great deal of conductive liquid and metal are induced from the outside because the metal band pieces 504*a* are not electrically insulated from the adjacent radiation fin 503.

Second, the conventional electric heater may be damaged or separated due to severe vibration of the car since the heating bodies 504 are exposed to the outside in a state where it is simply interposed between the radiation fins.

Third, the upper and lower frames 501 and 502 are fixed only by the side frame 507 in a state where they compress the wave type spring 506 and the radiation fins 503.

Thereby, the metal band piece 504*a* and the radiation fin 503 constituting the heating body 504 are not in well close contact with each other, and so, thermal conductivity is deteriorated.

The reason that the metal band piece 504*a* and the radiation fin 503 are not in well close contact with each other is that excessive pressure is applied to the side frame 507 and the external force relatively applied to the central part of the electric heater is reduced.

Fourth, the fixing band 504*c* mounted between the metal band pieces 504*a* is not charged with electricity and is hindered in heat transfer since it is made of insulating material.

Fifth, if only several heating bodies 504 of the plural heating bodies 504 mounted between the radiation fins 503 for controlling volume of electric power are charged with electricity, the PCT element 504*b* of the heating bodies 504 which are not charged with electricity acts as an insulator, and so, the heat transfer is partially carried out.

The reason is that the PTC element 504*b* is made of ceramic material which is weak in heat transfer.

Sixth, the wave type spring 506 for compressing the outside of the radiation fin 503 is mounted between the upper and lower frames 501 and 502 and the outside of the radiation fins 503.

However, the internal web 505 must be mounted to prevent buckling of the radiation fins 503 generated when excessive power is transferred to a certain position of the radiation fins 503 by the shape of the wave type spring 506, and so, the number of the components of the electric heater is increased and the assembly efficiency and productivity are deteriorated.

Seventh, an end portion of a wire connected to a power supply of the car for supplying electric power to the heating bodies 504 must be uprightly connected to the terminal 508, and so, it is very complicated to connect the wire to the terminal 508.

SUMMARY OF THE INVENTION

Accordingly, the present device has been made in view of the above problems occurring in the prior art, and it is an object of the present invention to provide an electric heater, which electrically and mechanically protects heating means from the outside, which increases heating value and thermal conductivity by increasing contact efficiency among components, and which improves assembly performance and productivity.

To achieve the above object, according to present invention, there is provided an electric heater including: a plurality of radiation members, each having a radiation fin and a radiation fin supporting plate surrounding the radiation fin formed integrally with the radiation fin by brazing; heating means having a guide plate having a plurality of through-holes, an electrode plate contacting with the guide plate, a plurality of PTC elements respectively inserted into the through-holes of the guide plate and contacting with the guide plate for generating heat when electric power is supplied, and an insulating film contacting with a side surface of the electrode plate; a plurality of flat tubes, each having the heating means therein, being located between the radiation members, the outer surface of the flat tube being compressed for fixing the heating means mounted therein; first and second support frames oppositely arranged on sides of the outermost radiation members for supporting and fixing the radiation members and the flat tubes; and first and second caps for supporting both end portions of the first and second support frames and both end portions of the flat tubes.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
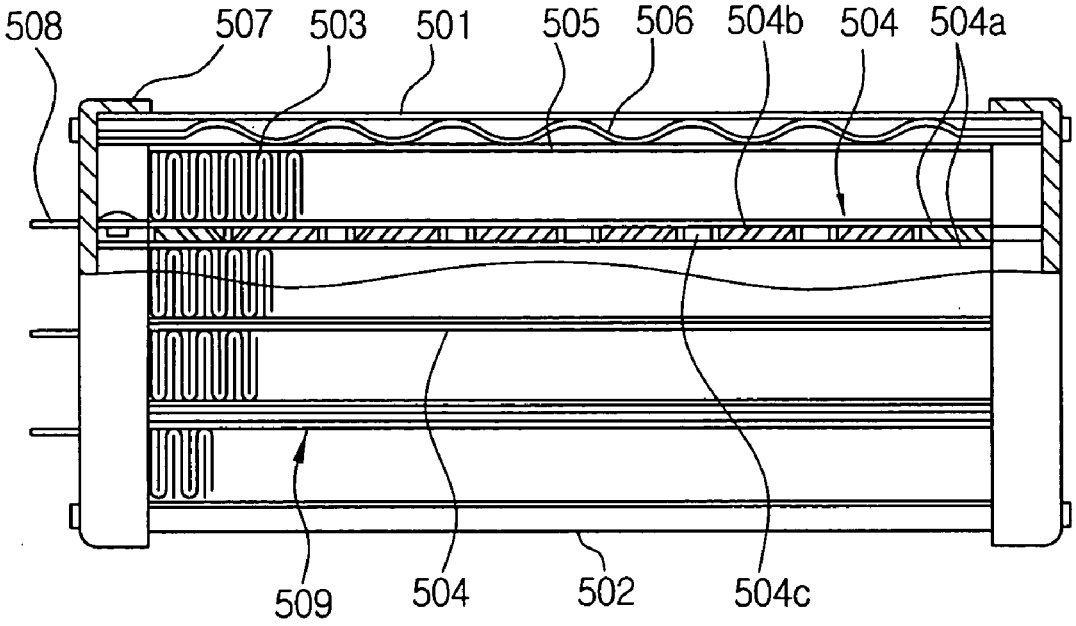
FIG. 1 is a sectional view of a conventional electric heater.
Figure 2:
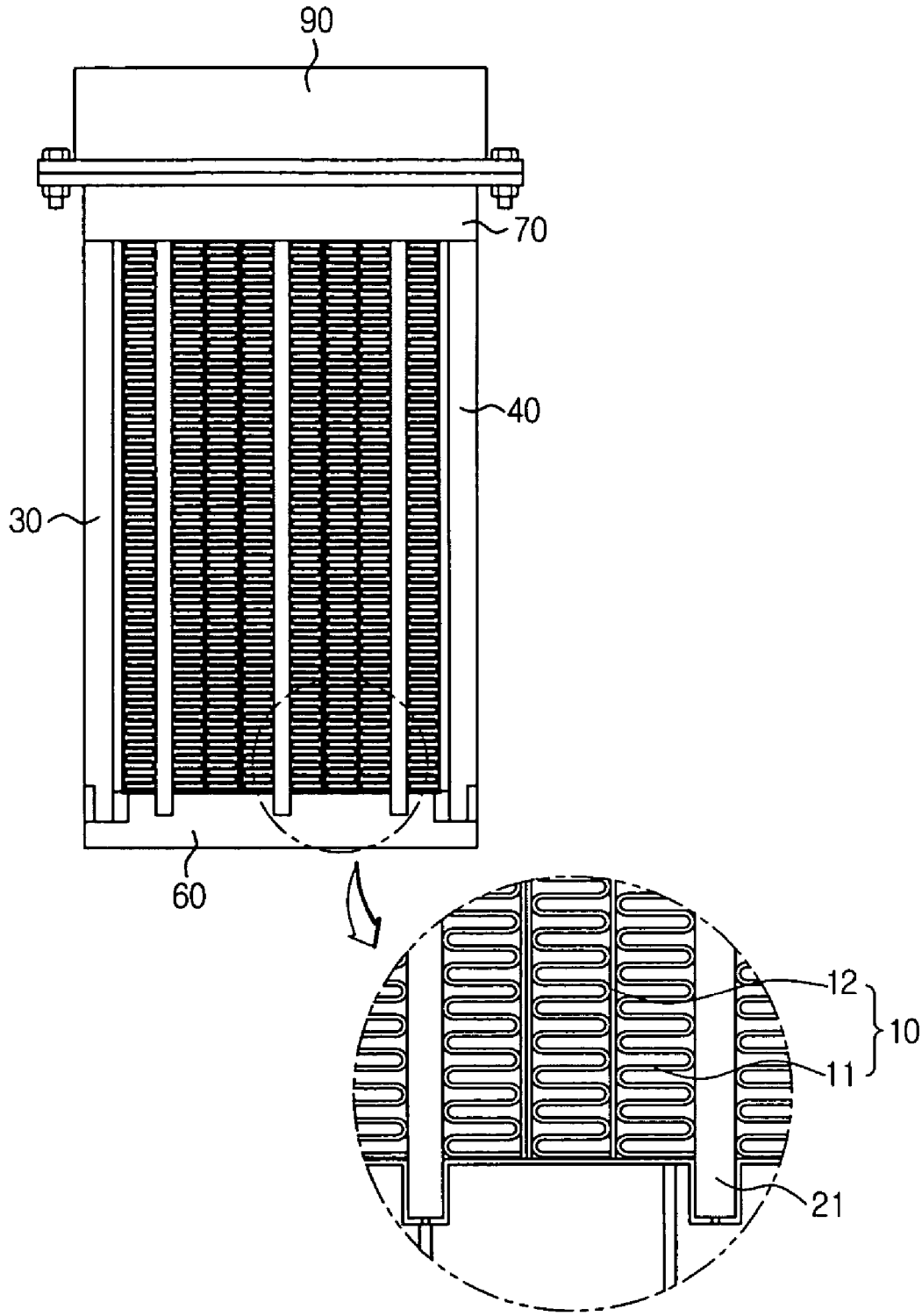
FIG. 2 is a front view of an electric heater according to a first preferred embodiment of the present invention.
Figure 3:
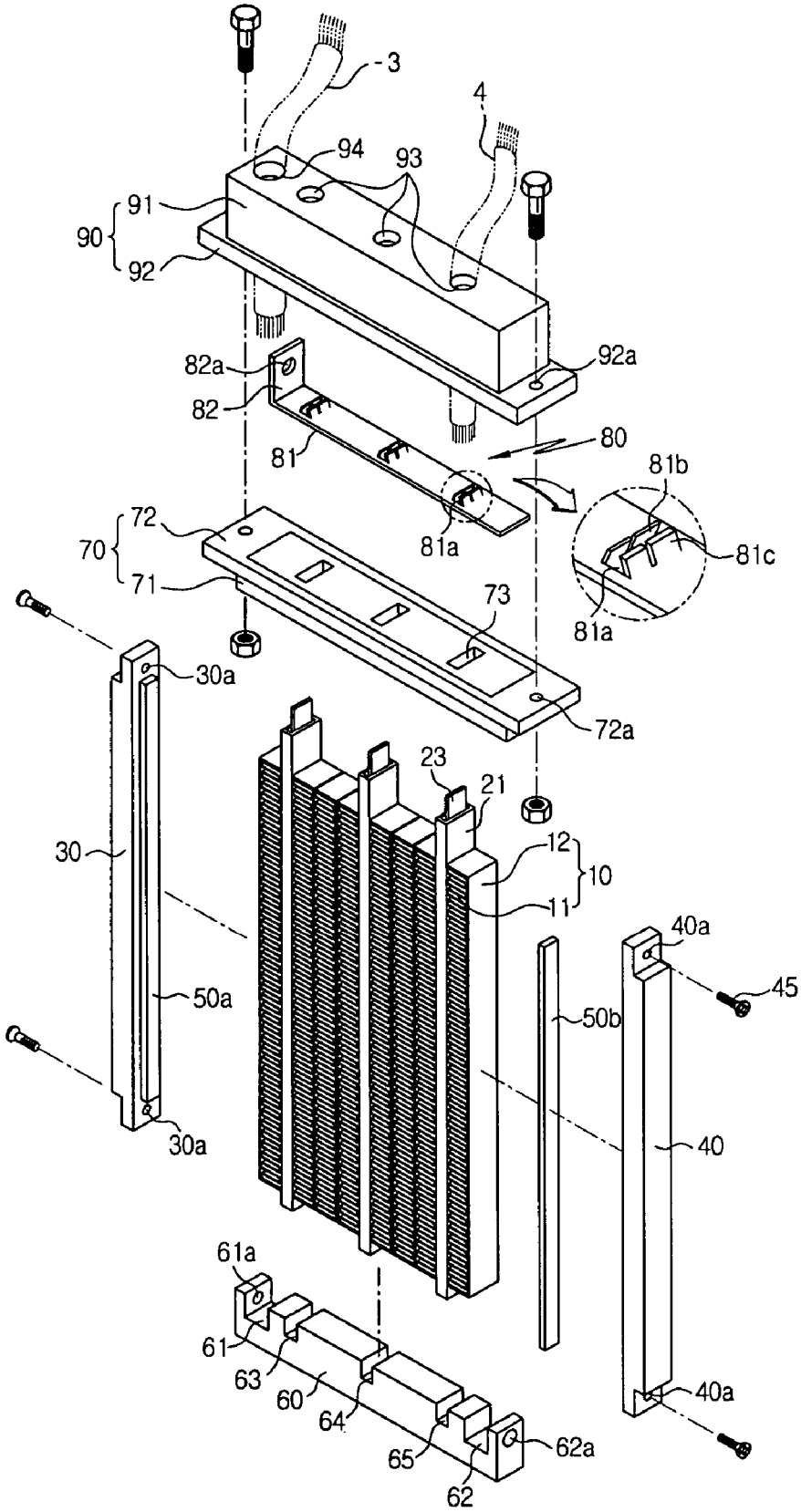
FIG. 3 is an exploded perspective view of the electric heater according to the first preferred embodiment.
Figure 4:
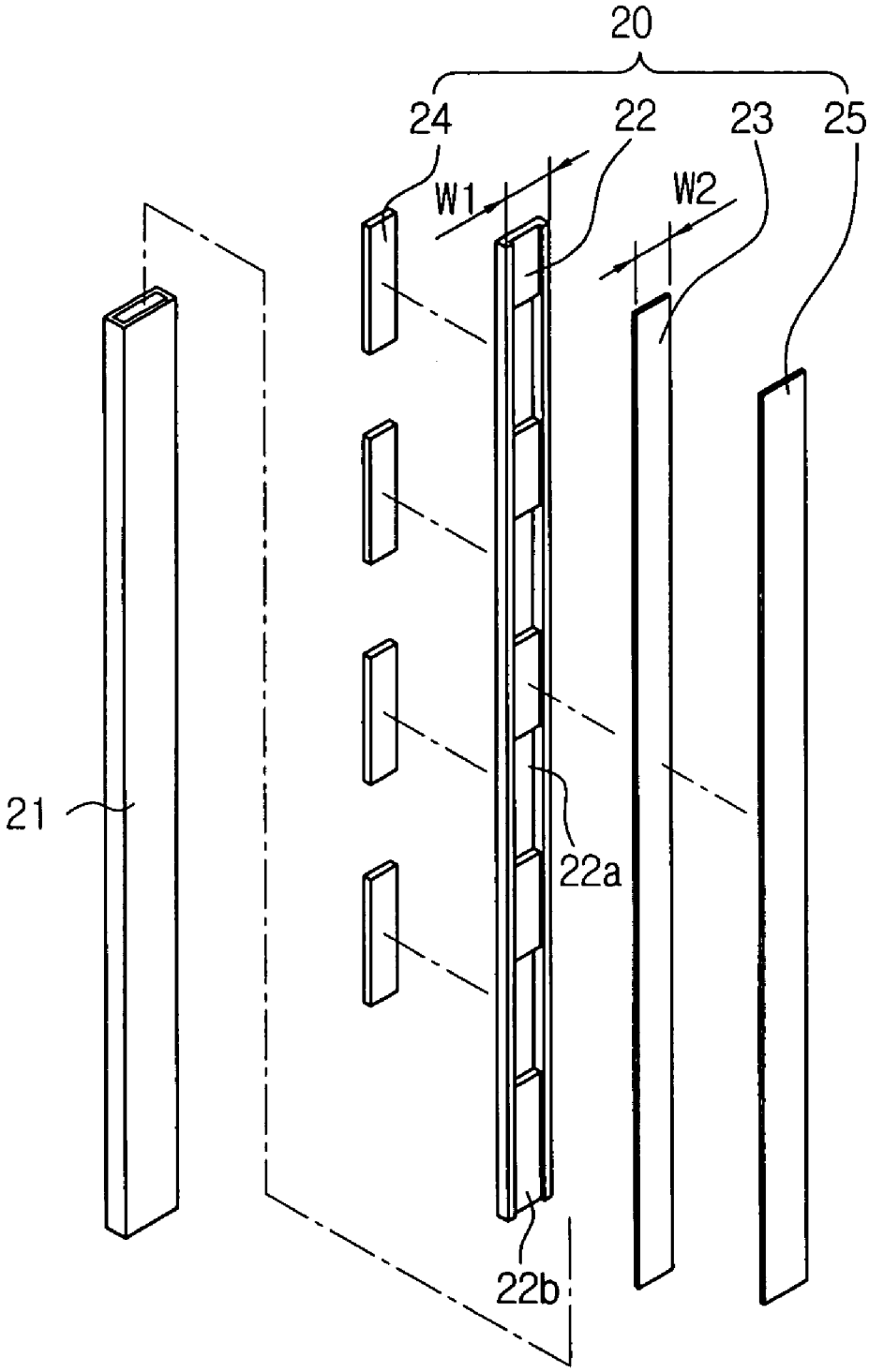
FIG. 4 is an exploded perspective view of heating means installed on the electric heater according to the first preferred embodiment.
Figure 5:
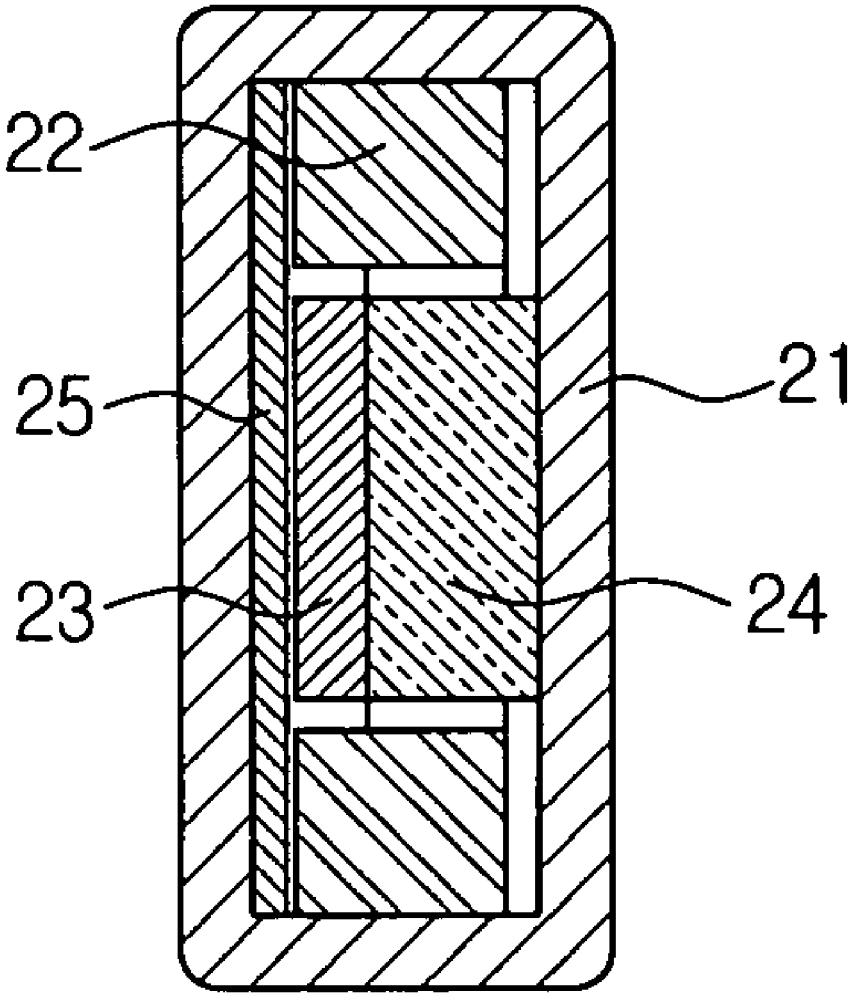
FIG. 5 is a sectional view showing a state where the heating means of FIG. 4 is assembled inside a flat tube.

FIG. 2 is a front view of an electric heater according to a first preferred embodiment of the present invention, FIG. 3 is an exploded perspective view of the electric heater according to the first preferred embodiment, FIG. 4 is an exploded perspective view of heating means installed on the electric heater according to the first preferred embodiment, and FIG. 5 is a sectional view showing a state where the heating means of FIG. 4 is assembled inside a flat tube.

First Embodiment

FIG. 2 is a front view of an electric heater according to a first preferred embodiment of the present invention, FIG. 3 is an exploded perspective view of the electric heater according to the first preferred embodiment, FIG. 4 is an exploded perspective view of heating means installed on the electric heater according to the first preferred embodiment, and FIG. 5 is a sectional view showing a state where the heating means of FIG. 4 is assembled inside a flat tube.

The electric heater according to the first preferred embodiment of the present invention includes a plurality of radiation members 10, heating means 20, a plurality of flat tubes 21, a first support frame 30, a second support frame 40, a first cap 60, and a second cap 70.

The radiation member 10 includes a radiation fin 11 and a radiation fin supporting plate 12 surrounding the radiation fin 11 and formed integrally with the radiation fin 11 by brazing.

The radiation fin 11 is in a corrugated type and made of aluminum thin film material for providing an easy heat transfer.

An end of the radiation fin supporting plate 12 is bended above the upper end surface of the radiation fin 11 in order to prevent protrusion and separation of the radiation fin 11 to the outside and to get the radiation fin 11 into line.

A method for manufacturing the radiation member 10 having the above structure includes the first step of temporarily assembling the radiation fin 11 and the radiation fin supporting plate 12, the second step of supporting the temporarily assembled radiation members 10 of the plural lines in a contact state among them using a jig after the first step, the third step of putting the radiation members 10 into a furnace after the second step, and the fourth step of brazing and integrally bonding the radiation fin 11 with the radiation fin supporting plate 12 after a brazing process of the temporarily assembled radiation member 10 inside the furnace.

The radiation fin supporting plate 12 and the radiation fin 11 are firmly fixed to each other by the above manufacturing method.

Meanwhile, when the method for manufacturing the radiation member 10 is progressed, a space for inserting the flat tube 21 in which the heating means 20 is mounted is formed.

A method for forming the space for inserting the flat tube includes the first step of temporarily assembling the radiation fin 11 and the radiation fin supporting plate 12, the second step of temporarily inserting a dummy plate of a predetermined thickness made of unbrazed material into a position where the flat tube 21 will be located and which is formed between the radiation members 10 formed by temporarily assembling the radiation fin 11 and the radiation fin supporting plate 12, the third step of supporting the temporarily assembled radiation member 10 and the dummy plate in a contact state with each other using the jig, the fourth step of putting the radiation member 10 into the furnace, the fifth step of brazing and integrally bonding the radiation fin 11 with the radiation fin supporting plate 12 after a brazing process of the radiation member 10 inside the furnace, sixth step of removing the dummy plate from the radiation member 10, and seventh step of inserting the flat tube 21 into a space formed by removing the dummy plate.

As described above, the radiation member 10 can be produced in mass quantity since the radiation fin 11 and the radiation fin supporting plate 12 are connected integrally with each other by the brazing.

Furthermore, the present invention can reduce loss of heat transfer between the radiation member 10 and the flat tube 21 since there does not occur coming-off between the radiation fin 11 and the flat tube 21 having the heating means 20 therein.

Moreover, in the radiation member 10, the radiation fin 11 and the radiation fin supporting plate 12 can be manufactured as one unit component by bonding them with an adhesive, and the radiation members 10 which are put on another can be connected with the flat tube having the heating means therein.

In addition, the present invention can simplify the manufacturing process and increase efficiency through a 'modularization of components' since the radiation member 10 and the flat tube 21 having the heating means 20 therein are respectively manufactured in mass quantity and simply assembled with each other.

Meanwhile, the flat tube 21 is made of metal material, which is opened at both ends and has a rectangular section, and is located between the radiation members 10. The heating means 20 which generates heat when electric power is supplied is inserted and mounted inside the flat tube 21.

As shown in FIG. 3, it is preferable that the flat tube 21 protrudes somewhat from both ends of the radiation member 10, has a length similar with that of the first and second support frames 30 and 40, and is longer than the radiation fin 20.

As shown in FIGS. 4 and 5, the heating means 20 includes a guide plate 22, an electrode plate 23, PTC elements 24 and an insulating film 25.

The guide plate 22 is made of insulating material, and has a plurality of through-holes 22*a* formed at fixed intervals.

The guide plate 22 has a concaved receiving portion 22*b* formed long on a side surface thereof in a longitudinal direction of the guide plate 22 for receiving a side surface of the electrode plate 23 in the longitudinal direction.

The width (W1) of the receiving portion 22*b* is similar to the width (W2) of the electrode plate 23.

The electrode plate 23 is in contact with the side surface of the guide plate 22.

The electrode plate 23 is made of conductive metal such as aluminum, and is a flat type rectangular plate. The electrode plate 23 has the thickness as thick as it protrudes from the receiving portion 22*b* when the electrode plate 23 is received into the receiving portion 22*b*.

As shown in FIGS. 3 and 4, the electrode plate 23 is longer than the flat tube 21, and is inserted into the flat tube 21 in such a way that an end portion of the electrode plate 23 protrudes from the flat tube 21 to the outside.

As will be described later, the electrode plate 23 is connected with a wire connected to the positive terminal of a power source of a car, and so, serves as the positive terminal. At this time, the components 10, 21, 22, 24 and 25 excluding the electrode plate 23 all serve as the negative terminal, and thereby, there is no need to use additional electrode plate having negative polarity which is used in prior arts.

Meanwhile, The PTC element 24 is a semiconductor ceramic element. FIG. 4 shows the PTC element 23 of a rectangular form, but it is not restricted to the above form. Of course, the form of the through-hole 22*a* of the guide plate 22 may be changed according to the form of the PTC element 24.

Furthermore, the insulating film 25 is made of resin which has good insulating performance and heat transfer efficiency, and so, does not generate circuit short due to the contact with the adjacent electrode plate 23 and flat tube 21, and can transfer heat generated by the PTC element 24 to the radiation fin 11 through the flat tube 21.

The heating means 20 mounted inside the flat tube 21 is assembled and fixed in the correct position in a state where the heating means 20 is in surface contact with the flat tube 21 without movement inside the flat tube 21 since both outer sides of the flat tube 21 are compressed.

Therefore, the heat value generated from the heating means 20 is increased since the components of the heating means 20 are in close contact with one another due to compression of the flat tube 21.

Moreover, in the heating means 20, the heat transfer efficiency toward the flat tube 21 and thermal contact power of the heating means 20 with the radiation fin 11 can be increased.

In addition, the conventional electric heat has several problems in that the heating means is damaged by the external force since it is exposed to the outside and occurs electric accidents since foreign inflows are induced from the outside. However, the heating means 20 according to the present invention is protected from the external shock and prevents introduction of foreign inflows from the outside since it is mounted inside the rectangular flat tube 21 and sealed from the outside.

The radiation member 10 and the flat tube 21 having the heating means 20 therein are firmly assembled in a state where they are supported by the first and second support frames 30 and 40 after they are assembled.

The radiation member 10 and the flat tube 21 supported between the first and second support frames 30 and 40 can be closely bonded to each other by applying predetermined pressure to the outer surfaces of the first and second support frames 30 and 40 or by coating an adhesive on the outer surface of the flat tube 21.

Meanwhile, as a method for bonding the radiation member 10 and the flat tube 21 with each other, there are three methods: one being a method of thermally treating and hardening the adhesive for a predetermined time period at a predetermined temperature, for example, for an hour at temperature of 150° C.; another being a method of naturally hardening for a predetermined time period; the other being a method of hardening them by heat generated from the PTC element 24.

By the above methods, the present invention can reduce the number of components and improve assembly efficiency and productivity since the present invention does not need additional components, which are used in the conventional electric heater, such as the wave type spring used for increasing thermal contact power between the radiation fin and the heating body and the internal web for preventing buckling of the radiation fin occurring by the wave type spring.

The first and second support frames 30 and 40 are made of metal material for protecting the radiation member 10 and the flat tube 20 from the external power.

However, if the first and second support frames 30 and 40 are made of metal material, there may occur heat loss and a plastic case (not shown) for receiving the electric heater may be transformed since heat generated from the heating means 20 to the radiation member 10 is transferred to the first and second support frames 30 and 40 when electric power is supplied to the heating means 20.

Therefore, to prevent the above problems, according to the present invention, heat insulation members 50*a* and 50*b* are respectively mounted between the first support frame 30 and the outermost radiation fin supporting plate 22 and between the second support frame 40 and the outermost radiation fin supporting plate 22.

The heat insulation members 50*a* and 50*b* are firmly adhered on the inner surfaces of the first and second support frames 30 and 40 by adhering means.

As described above, as shown in FIG. 3, the plural flat tube 21, in which the heating means assembled by the first and second support frames 30 and 40 is mounted, and the plural radiation members 10 are supported and fixed by the first and second caps 60 and 70 opposed to each other in a vertical direction.

The first cap 60 includes first holes 61 and 62 formed at both end portions thereof for inserting and assembling the lower end portions of the first and second support frames 30 and 40, and coupling holes 61*a* and 62*a* formed on the outer walls of the first holes 61 and 62 for detachably coupling the support frames 30 and 40 via coupling means such as screws.

Furthermore, the first and second support frames 30 and 40, which are respectively inserted into the first hole 61 and 62, respectively have stepped portions formed on the lower end portions thereof in a longitudinal direction of the support frames 30 and 40 to be detachably coupled with the first hole 61 and 62 of the first cap 60 via the coupling means, and coupling holes 30*a* and 40*a* corresponding to the coupling holes 61*a* and 62*a* of the first cap 60 and formed on the stepped portions.

Moreover, the first cap 60 further includes a plurality of second holes 63, 64 and 65 formed between the first holes 61 and 62, which are formed at both end portions thereof, at predetermined intervals for respectively inserting the lower end portions of the plural flat tubes 21 thereinto.

Meanwhile, the second cap 70 includes a tube body 71 and a plate body 72.

The tube body 71 is in the form of a rectangle and has a receiving part for receiving the upper end portions of the plural flat tubes 21 and the first and second support frames 30 and 40 while supporting the upper end portions of the plural radiation members 10.

The plate body 72 is formed integrally with the upper portion of the tube body 71, and has a plurality of openings 73 formed at predetermined intervals for passing the upper end portions of the plural flat tubes 21 received in the receiving part of the tube body 71.

The plate body 72 is longer than the tube body 71 in such a way as to protrude from both side walls of the tube body 71, and has coupling holes 72*a* formed on both end portions thereof.

Here, the outer upper end portions of the first and second support frames 30 and 40 have the same form as the outer lower end portions of the first and second support frames 30 and 40, and so, can be detachably coupled with the second cap 70 through coupling holes (not shown) respectively formed on both side walls of the tube body 71 via coupling means such as screws.

The first and second caps 60 and 70 are made of insulating material to be electrically insulated from the radiation members 10 and the flat tubes 20 having the heating means 20 therein.

Furthermore, a common terminal plate 80 is located on the upper portion of the second cap 70 made of conductive metal material for connecting and fixing the plural flat tubes 21 protruding through the plural openings 73 of the second cap 70 to connect the flat tubes 21 to the power source.

As shown in FIG. 3, the common terminal plate 80 includes a tube insertion part 81 and a wire connection part 82.

The tube insertion part 81 includes a number of insertion holes 81*a* for inserting the upper end portions of the plural flat tubes 21 protruding from the openings 73 of the second cap 70.

The wire connection part 82 includes a hole 82*a* formed on an upwardly bended portion formed at an end portion of the tube insertion part 81 to be connected with a second wire 4 which has different pole from a first wire 3 connected to the electrode plate 23 located inside the flat tube 21.

A pair of compressing pieces 81*b* and 81*c* are formed on both side walls of each insertion hole 81*a* formed on the tube insertion part 81 inclinedly protruding in the opposite direction for compressing and fixing the outer surfaces of the flat tubes 21 inserted into the insertion holes 81*a*.

The first wire is connected to an end portion of the electrode plate 23 located inside the flat tube 21 inserted through the insertion hole 81*a* of the tube insertion part 81 in parallel with the longitudinal direction of the flat tube 21.

In particular, a cover 90 for protecting the common terminal plate 80 from the outside is detachably coupled with the second cap 70 via coupling means such as bolts, and at this time, the common terminal plate 80 is interposed between the cover 90 and the second cap 70.

The cover 90 includes a tube body 91 having the internal space for receiving the common terminal plate 80, and a combining part 92.

The combining 92 is formed integrally with the lower edge of the tube body 91 and opposed to the common terminal plate 80, and has coupling holes 92*a* formed on portions protruding from both side walls of the tube body 91.

Moreover, the upper surface of the tube body 91 includes a plurality of first through-holes 93 for passing the first wire 3 connected to the positive terminal of the power source of the car in such a way that the first wire 3 is connected to the electrode plate 23 of the flat tube 21 connected to the common terminal plate 80 in a line, and a plurality of second through-holes 94 for passing the second wire connected to the negative terminal of the power source of the car in such a way that the second wire is connected to the hole 82*a* of the wire connection part 82 of the common terminal plate 80 in a line.

According to the first preferred embodiment of the present invention, the radiation member 10 and the flat tube 21 having the heating means 20 therein can be detachably fixed by the first and second support frames 30 and 40 and the first and second caps 60 and 70.

Therefore, the radiation member 10 and the flat tube 21 having the heating means 20 therein are not easily separated from each other even by vibration generated during driving of the car, and increase the contact efficiency therebetween.

The electric heater according to the present invention can be easily assembled and disassembled.

In the electric heater according to the present invention, when electric power is applied through the first wire 3 (namely, positive wire) and the second wire 4 (namely, negative wire) respectively connected to the electrode plate 23 located inside the flat tube 21 connected to the common terminal plate 80 and the wire connection part 82 of the common terminal plate 80, the plural PTC elements 24 which is in close contact with the electrode plate 23 starts to generate heat.

After that, the heat generated from the plural PTC elements 24 is transferred to the flat tubes 21 through the electrode plate 23, and then, transferred to the outside through the radiation fins 11 bonded to the flat tubes 21, thereby heating the air.

As shown in FIGS. 2 and 3, a plurality of the heating means 20 according to the present invention are installed (for your convenience, three heating means 20 are shown in the drawings), and the number of the heating means 20 is decided in consideration of heating volume and performance of the car.

Meanwhile, the radiation members 10 and the flat tubes 21 having the heating means 20 therein can be installed in turn if necessary.

The flat tubes 21 having the heating means 20 therein can connect and interrupt the power source through a relay switch of the car since the flat tubes 21 are electrically connected with one another in parallel.

Here, the relay switch can be controlled to connect and interrupt the power source independently using a control unit.

Meanwhile, if the electric heater having the plural flat tubes 21 in which the heating means 20 are mounted is installed in the car, the electric heater may be restricted in volume due to restriction of volume of a power generator and a battery of the car.

For example, the electric heater according to the present invention may heat only the heating means 20 mounted inside several flat tubes 21 of the plural flat tubes 21.

However, even though only the several heating means 20 are heated, the radiation members 10 and the flat tubes 21 are thermally connected by the close contact bonding with each other.

Therefore, the electric heater according to the present invention is higher in heat transfer efficiency than the conventional electric heater. The reason is that heat generated by the heating means 20 is transferred from one flat tube 21 to another flat tube 21 through the radiation member 10 adjacent to the flat tube 21, and then, diffused to the whole area of the electric heater.

Moreover, the present invention can reduce temperature deviation of the air passing the electric heater.

Second Embodiment

Figure 6:
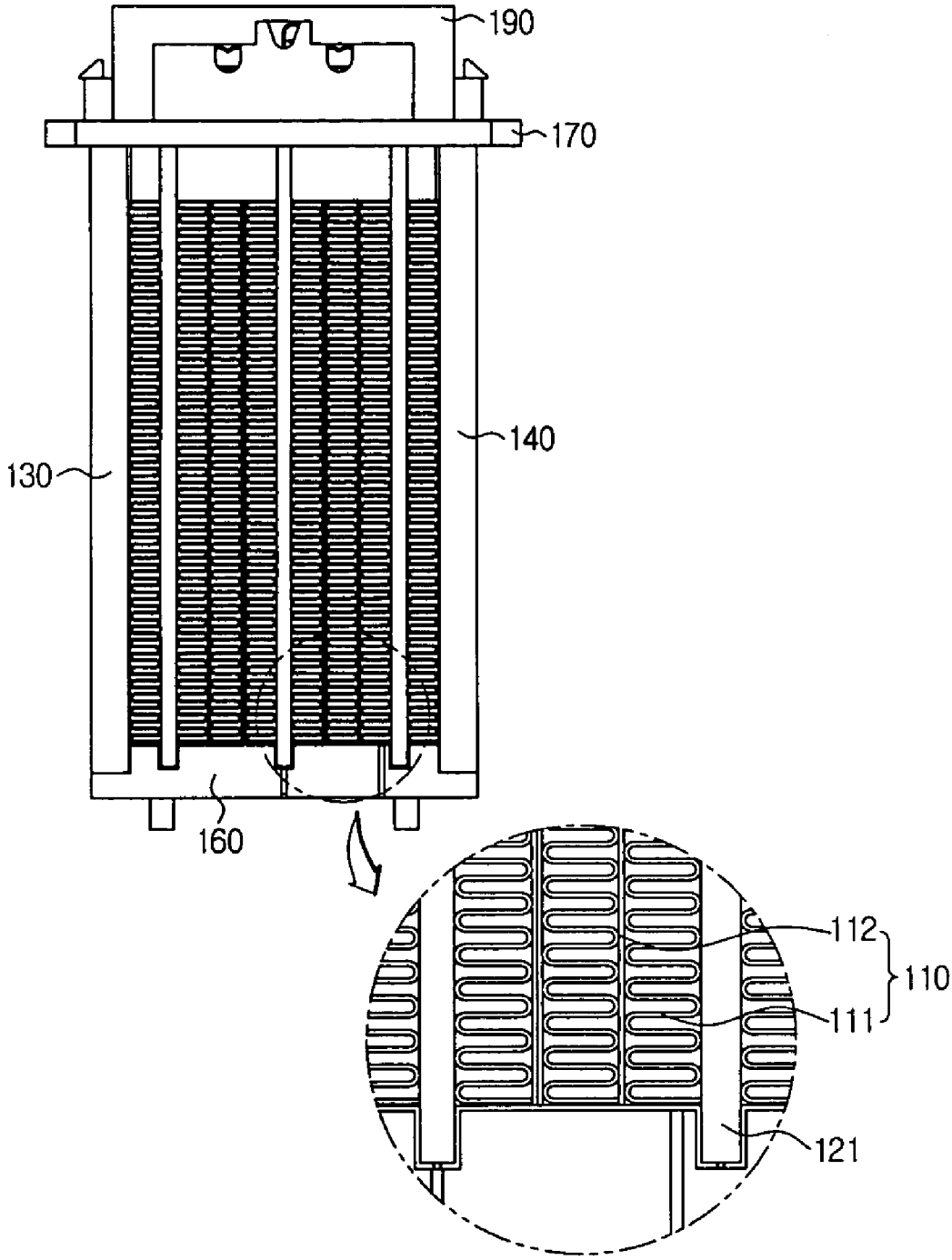
FIG. 6 is a front view of an electric heater according to a second preferred embodiment of the present invention.
Figure 7:
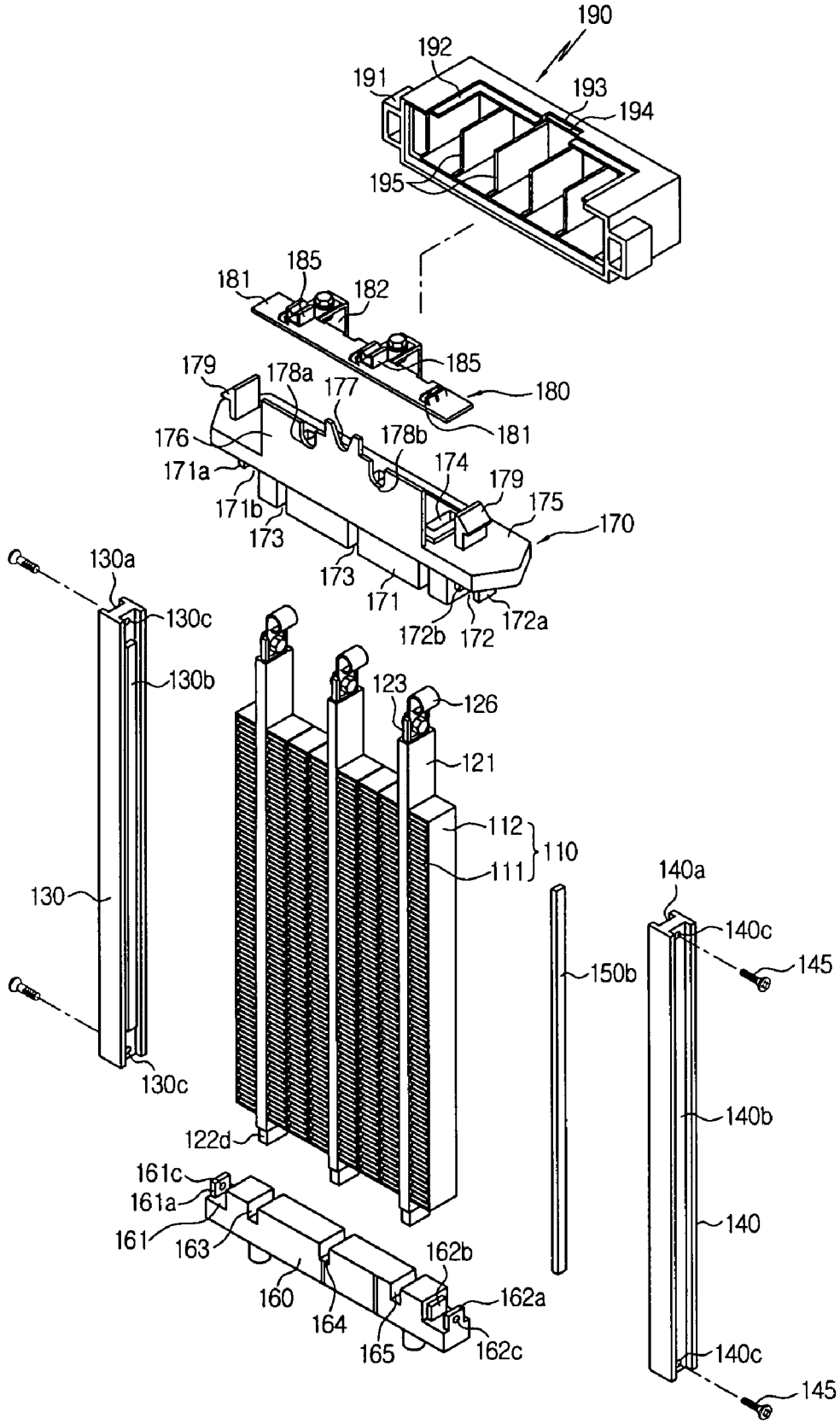
FIG. 7 is an exploded perspective view of the electric heater according to the second preferred embodiment.
Figure 8:
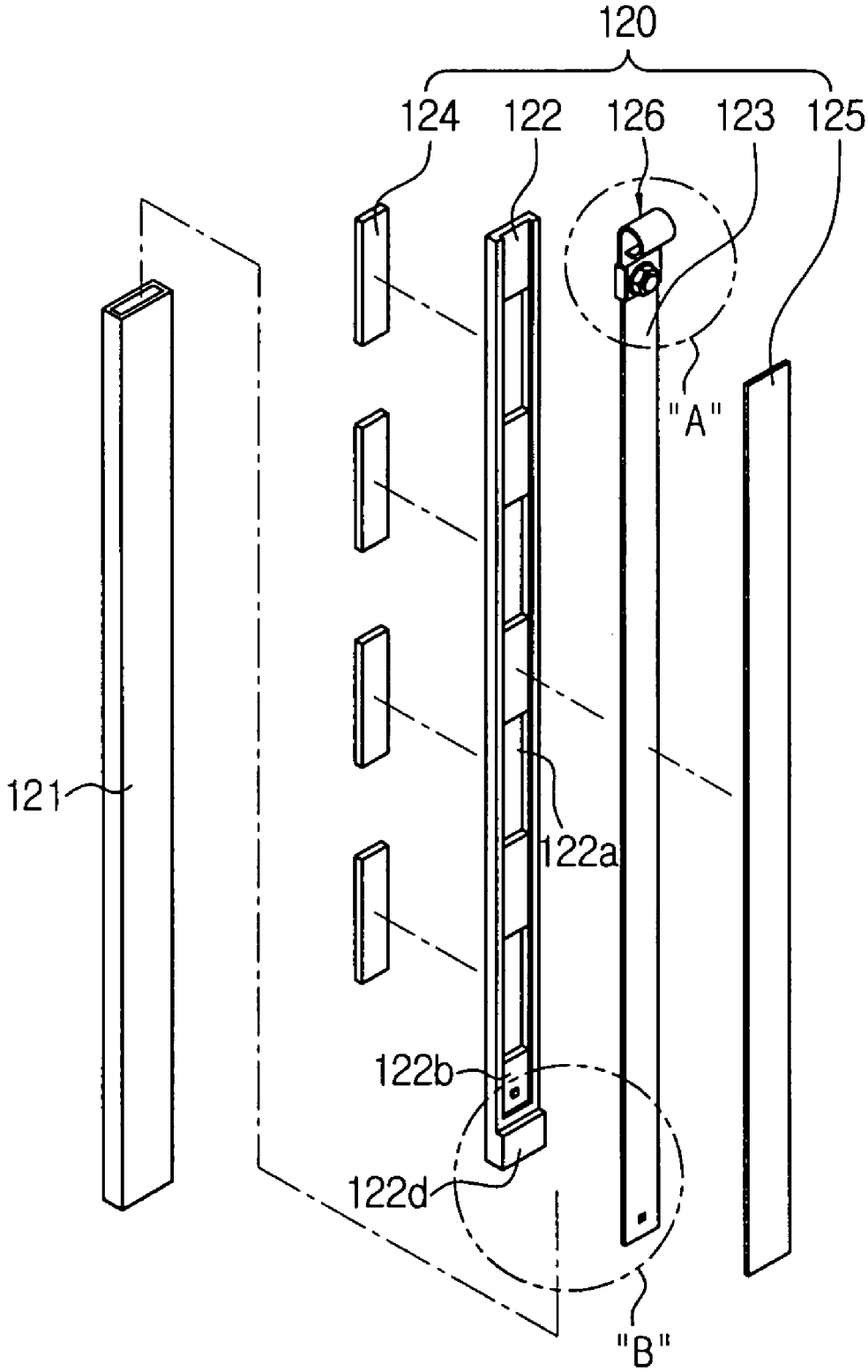
FIG. 8 is an exploded perspective view of heating means installed on the electric heater of the second preferred embodiment together with a first preferred embodiment of a first wiring part.
Figure 9:
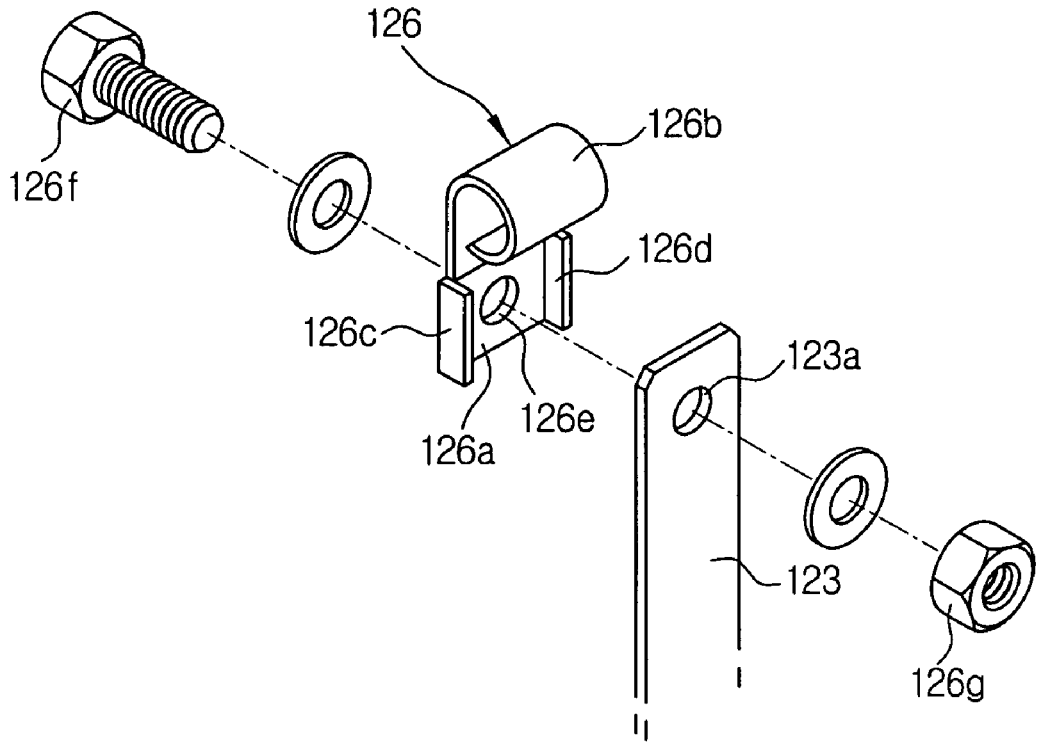
FIG. 9 is a perspective view of the first preferred embodiment of the first wiring part, which is an enlarged perspective view taken along the line of 'A' of FIG. 8.
Figure 10:
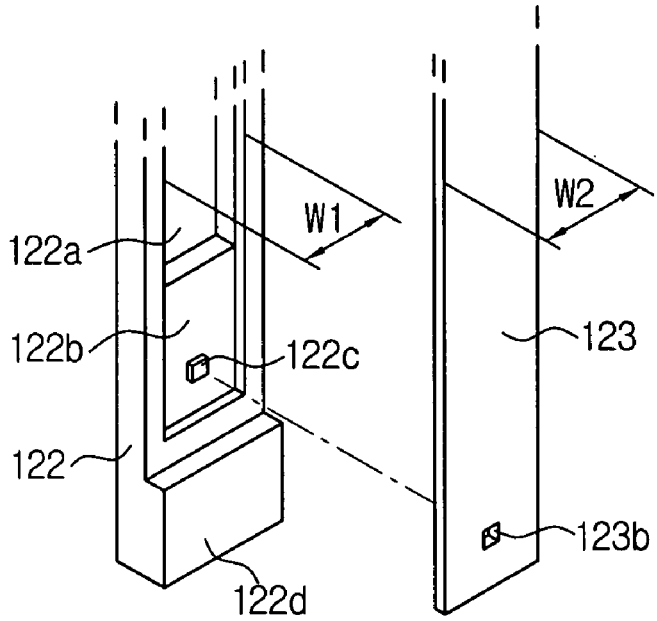
FIG. 10 is an enlarged perspective view taken along the line of 'B' of FIG. 8.
Figure 11:
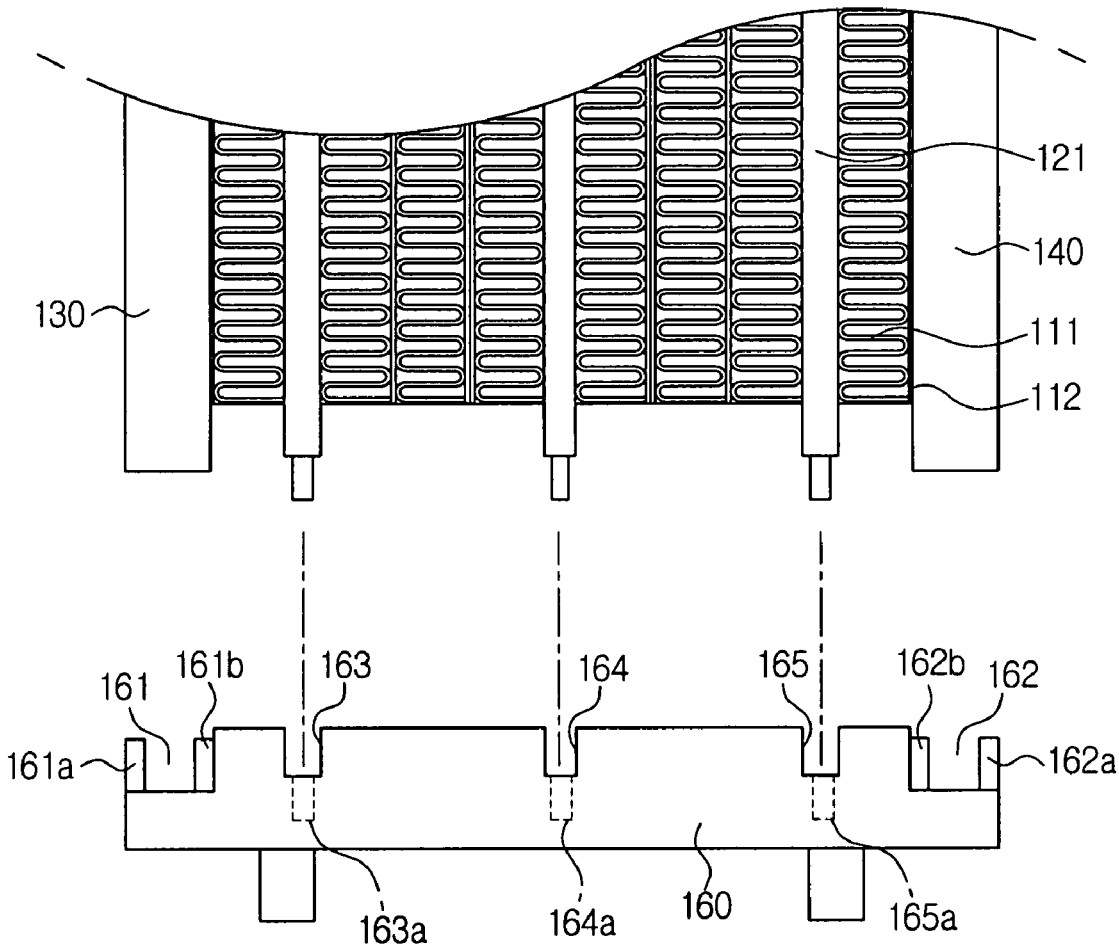
FIG. 11 is a sectional view showing an assembled state of the lower end part of the electric heater according to the second preferred embodiment.
Figure 12:
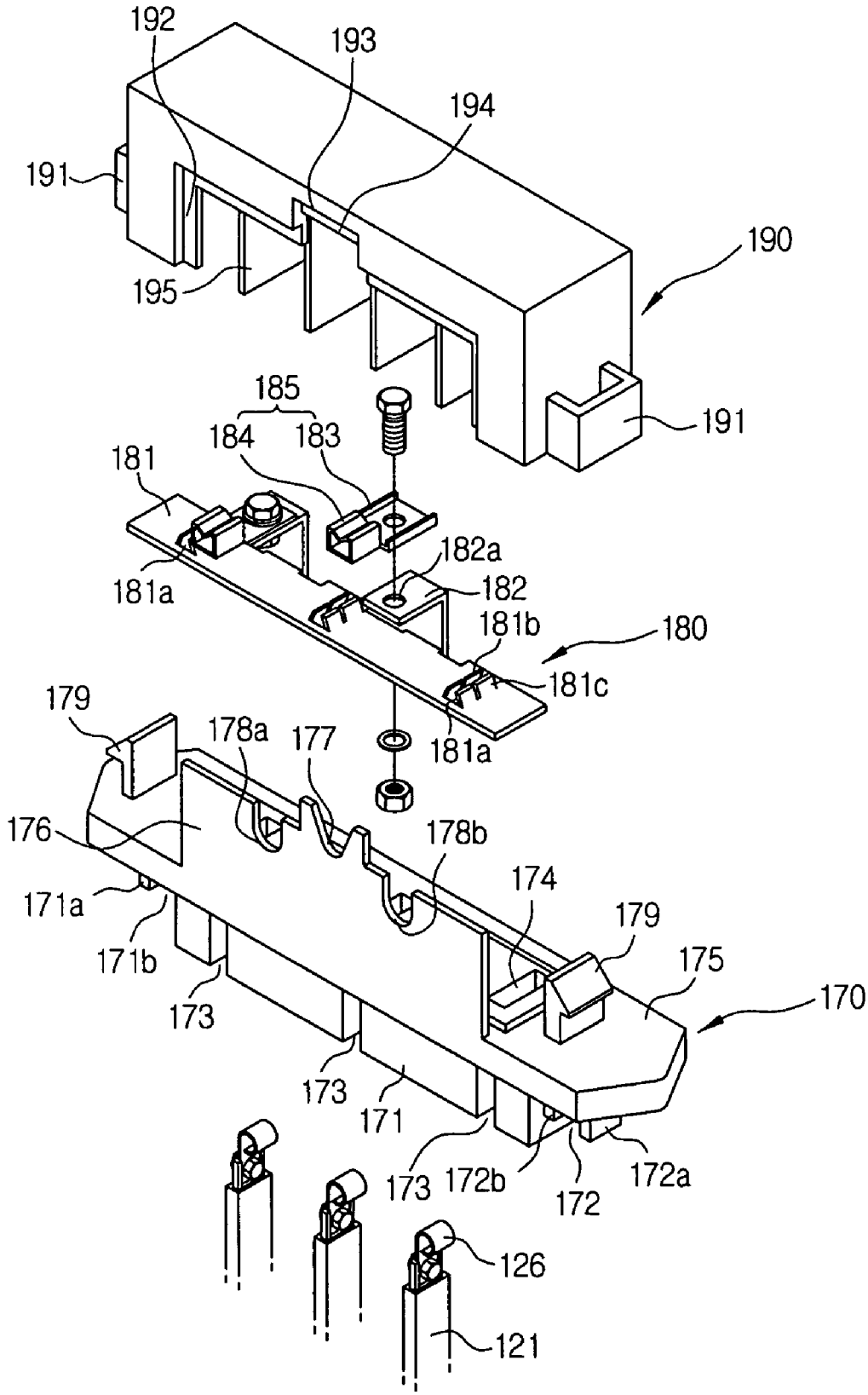
FIG. 12 is an exploded perspective view showing an assembled state of the upper end part of the electric heater according to the second preferred embodiment.
Figure 13:
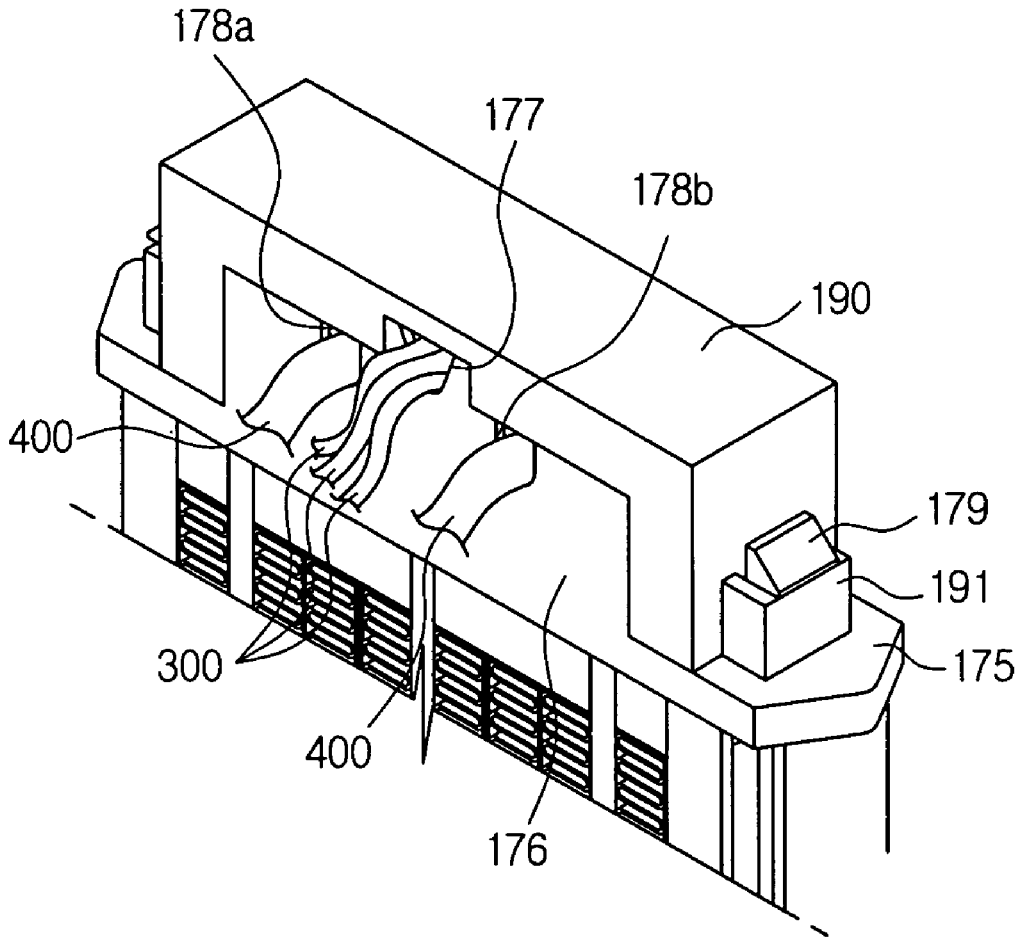
FIG. 13 is a perspective view showing a state where a cover is coupled with a second cap of the electric heater according to the second preferred embodiment.
Figure 14:
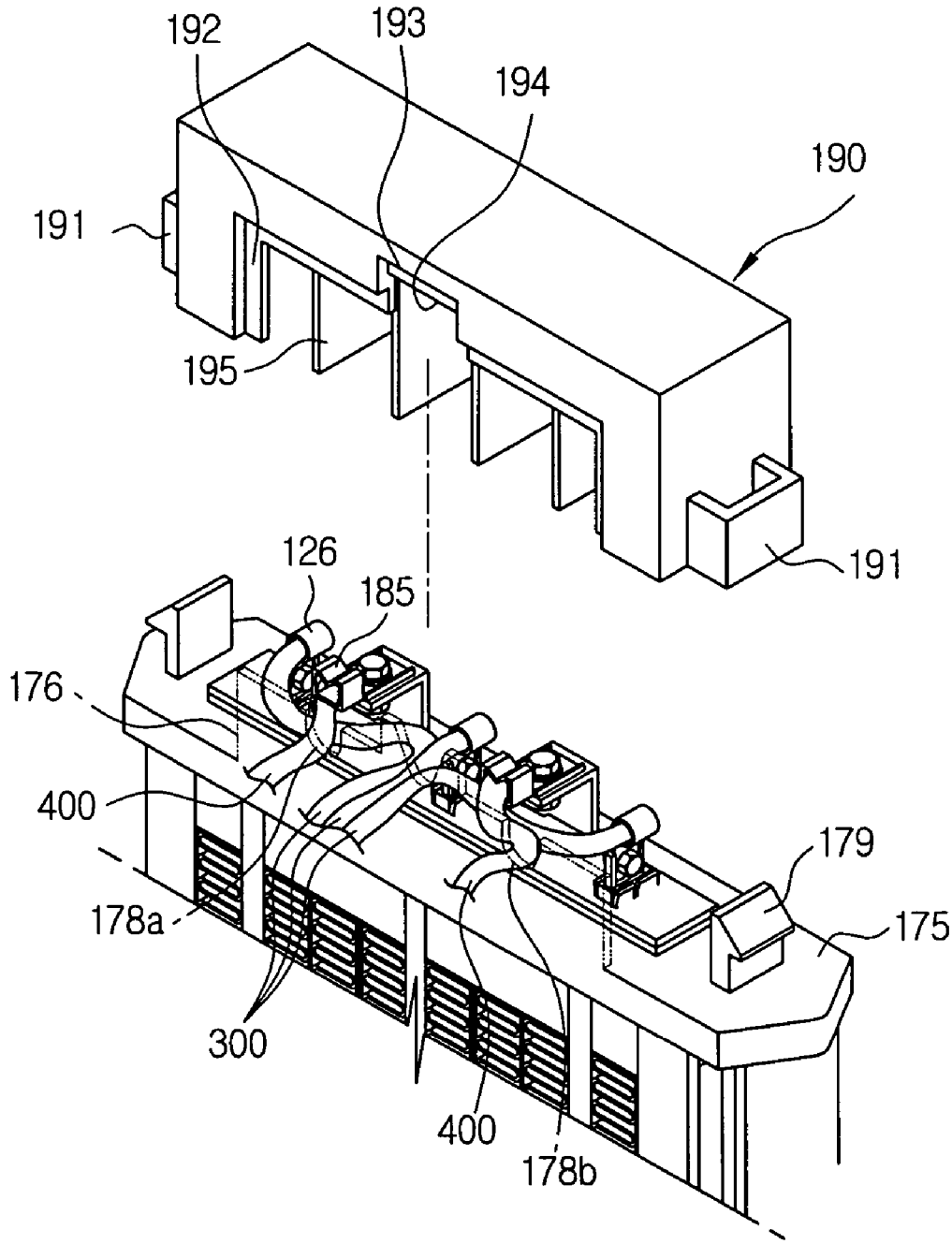
FIG. 14 is a partially perspective view showing a state where first and second wirings are installed in a state where the second cap and the cover of the electric heater of the second preferred embodiment are assembled with each other.
Figure 15:
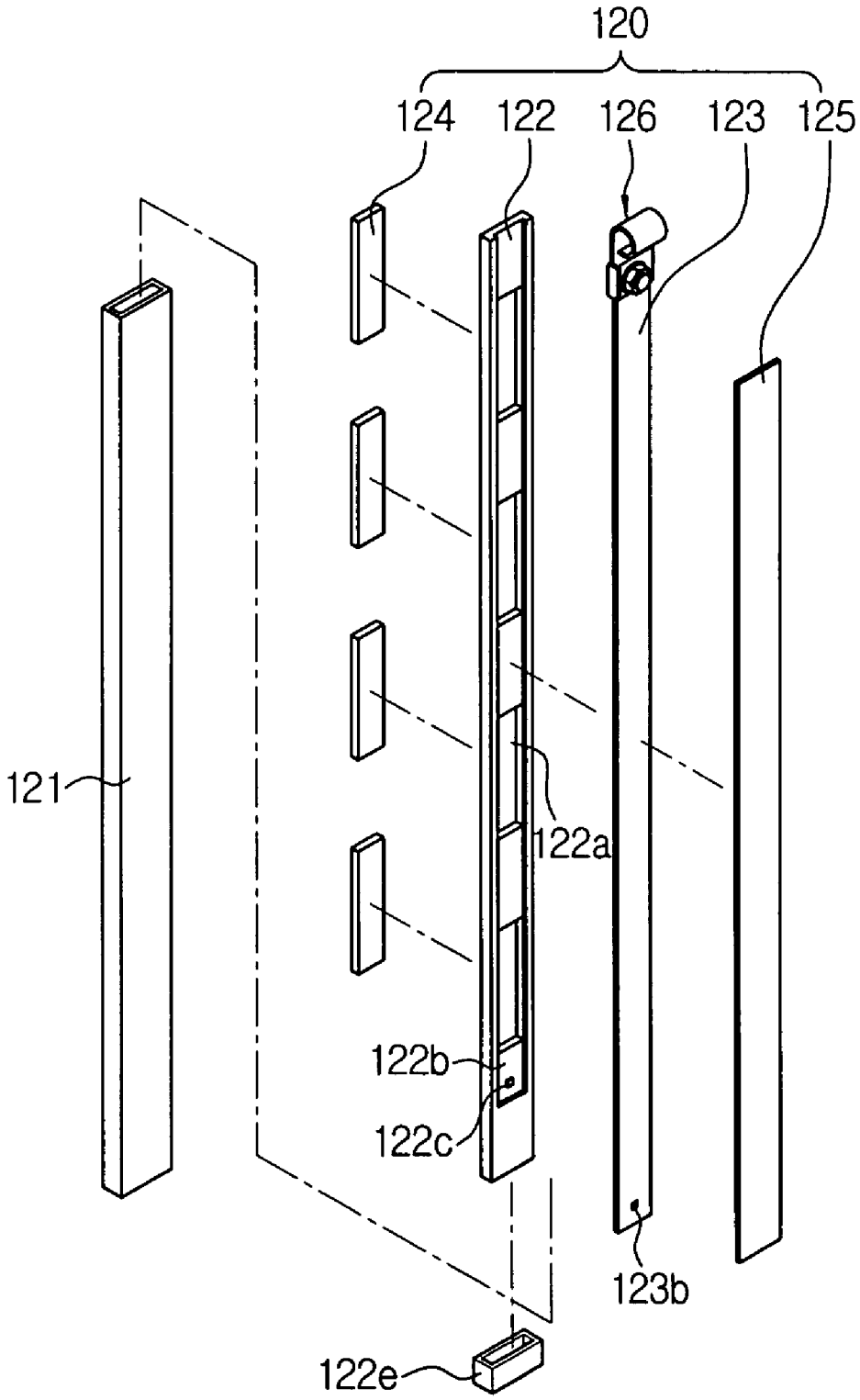
FIG. 15 is an exploded perspective view of heating means of the electric heater which has foreign inflow preventing means.
Figure 16:
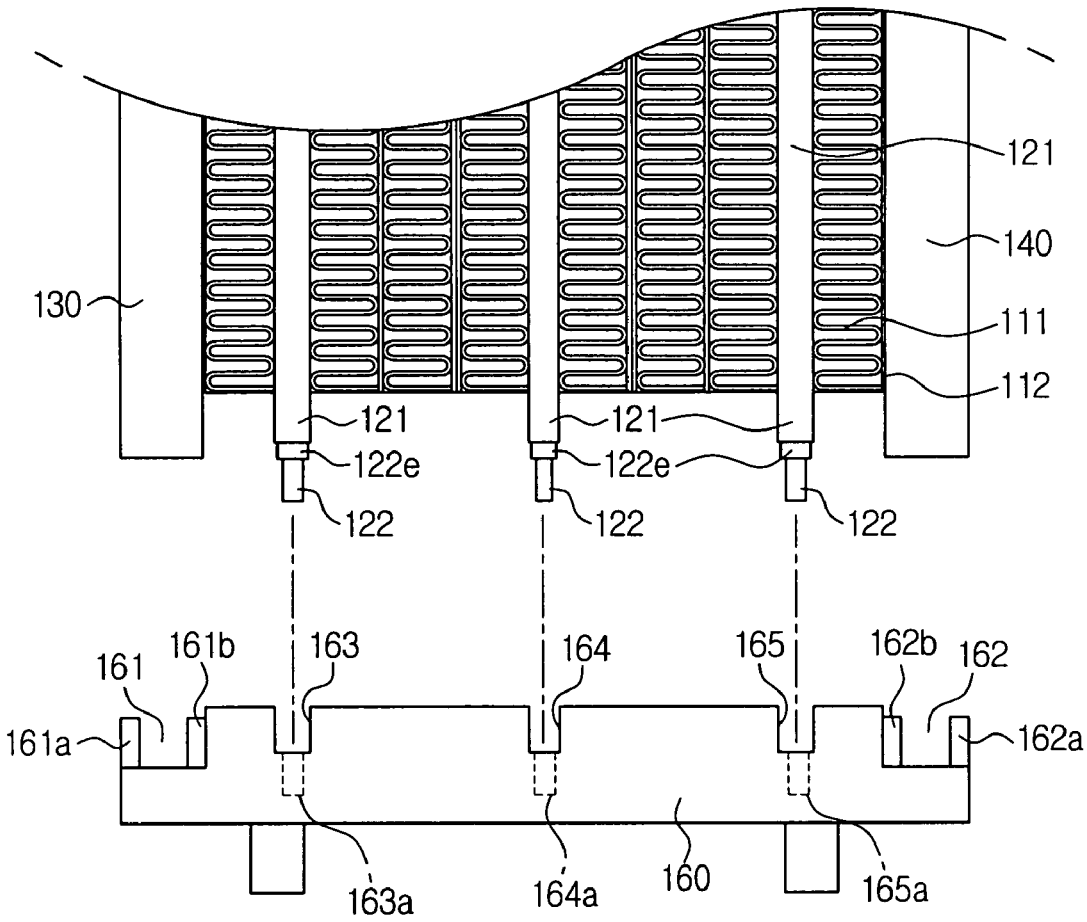
FIG. 16 is a partially sectional view of an assembled state of the lower end part of the electric heater having the foreign inflow preventing means.
Figure 17:
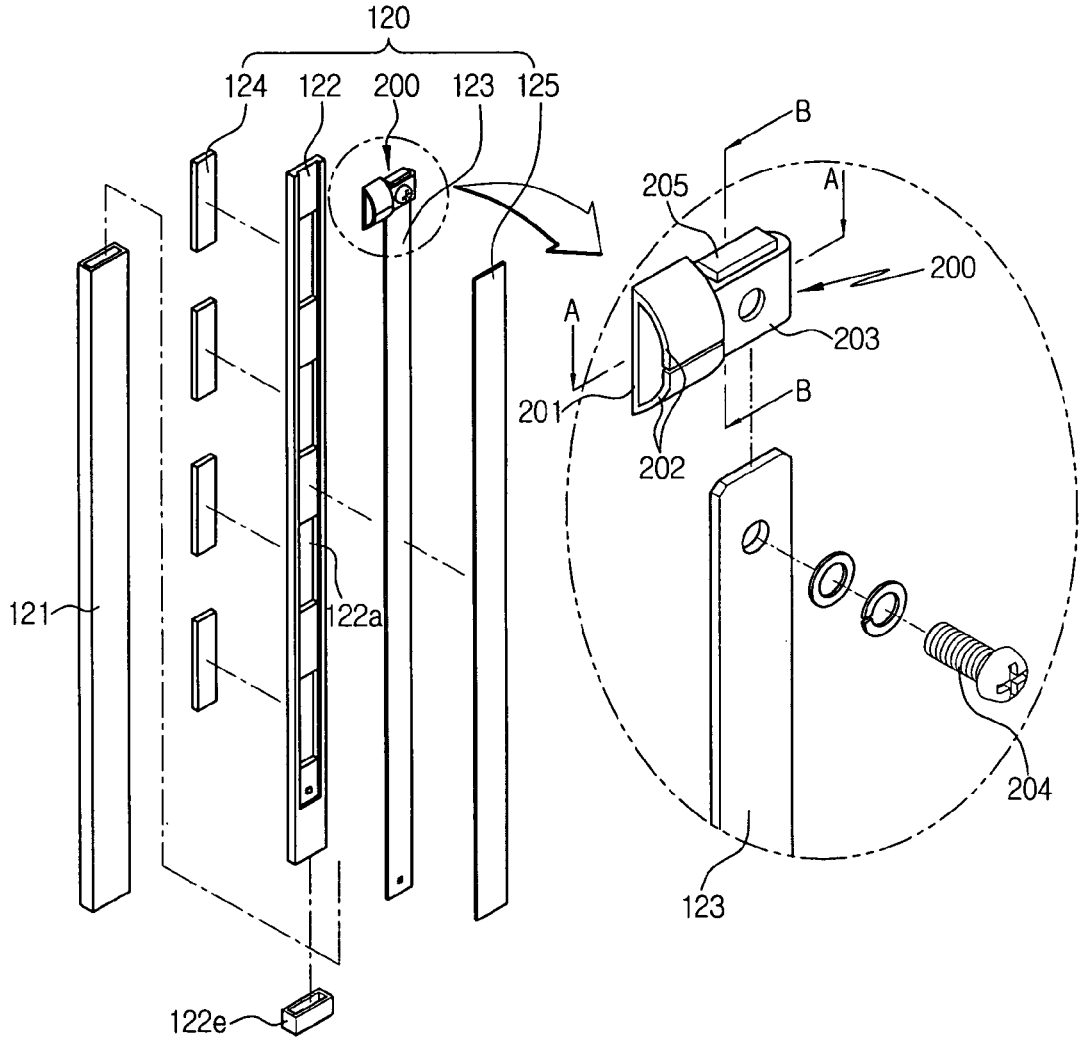
FIG. 17 is an exploded perspective view of the heating means to which the second preferred embodiment of the first wiring part is applied.
Figure 18:
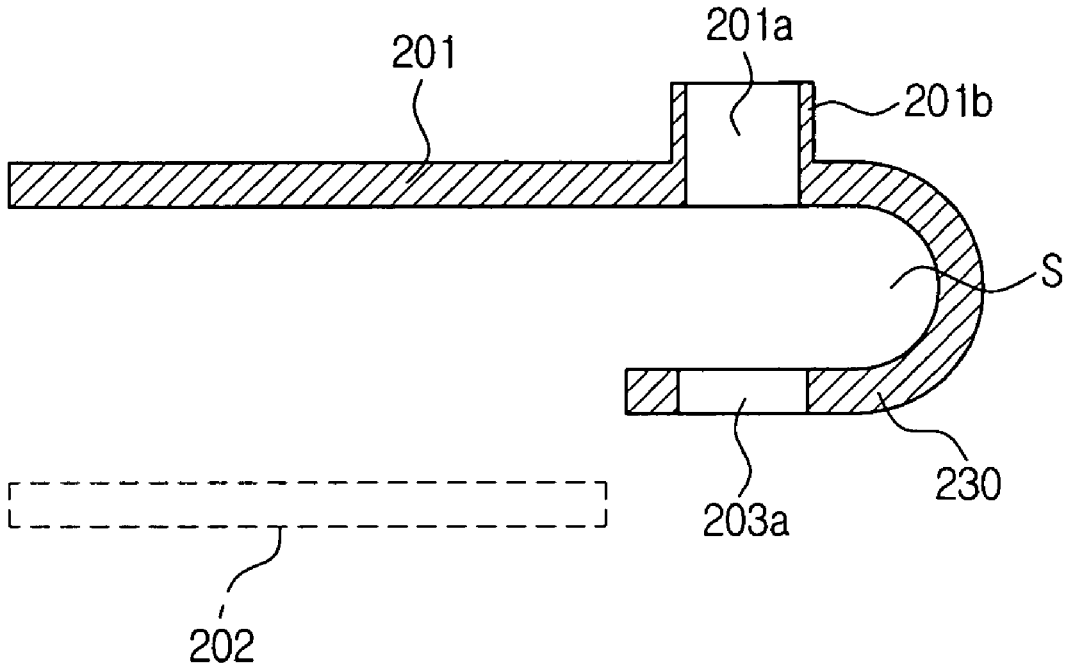
FIG. 18 is a sectional view taken along the line of "A—A" of FIG. 17.
Figure 19:
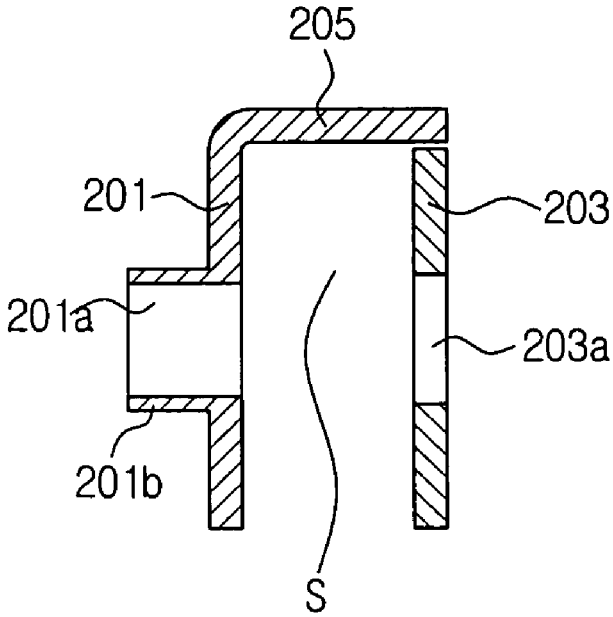
FIG. 19 is a sectional view taken along the line of "B—B" of FIG. 17.
Figure 20:
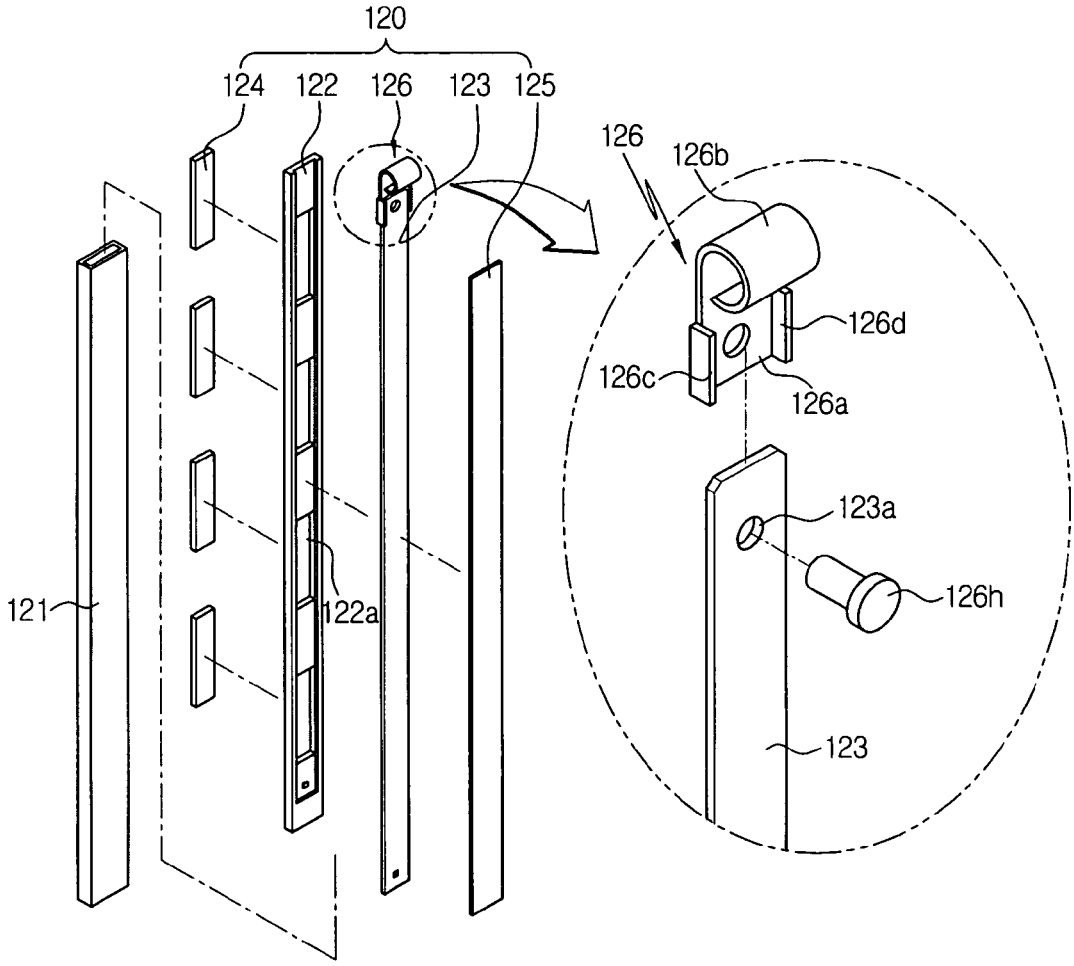
FIG. 20 is an exploded perspective view of the heating means to which the third preferred embodiment of the first wiring part is applied.
Figure 21:
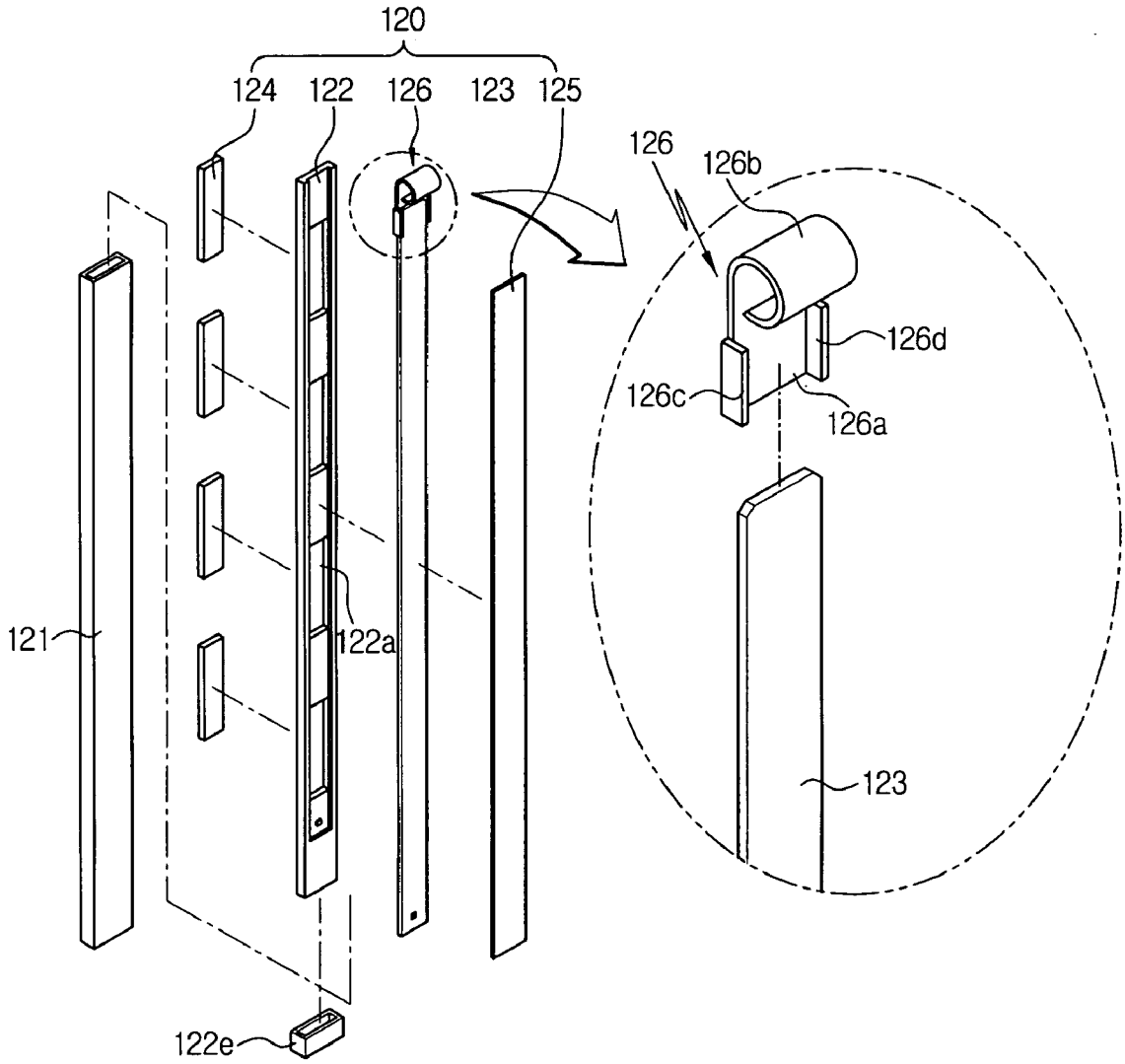
FIG. 21 is an exploded perspective view of the heating means to which the fourth preferred embodiment of the first wiring part is applied.
Figure 22:
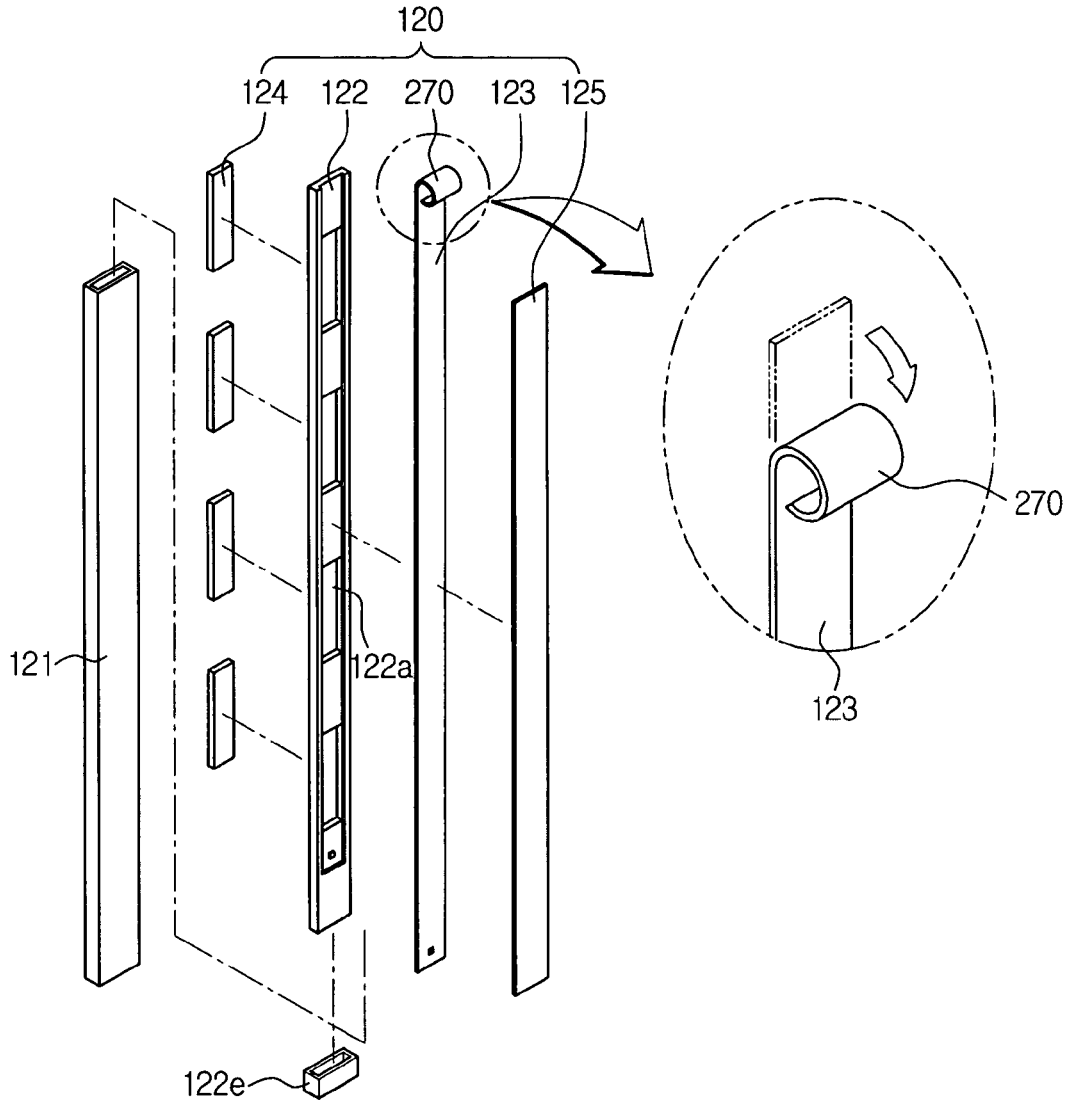
FIG. 22 is an exploded perspective view of the heating means to which the fifth preferred embodiment of the first wiring part is applied.
Figure 23:
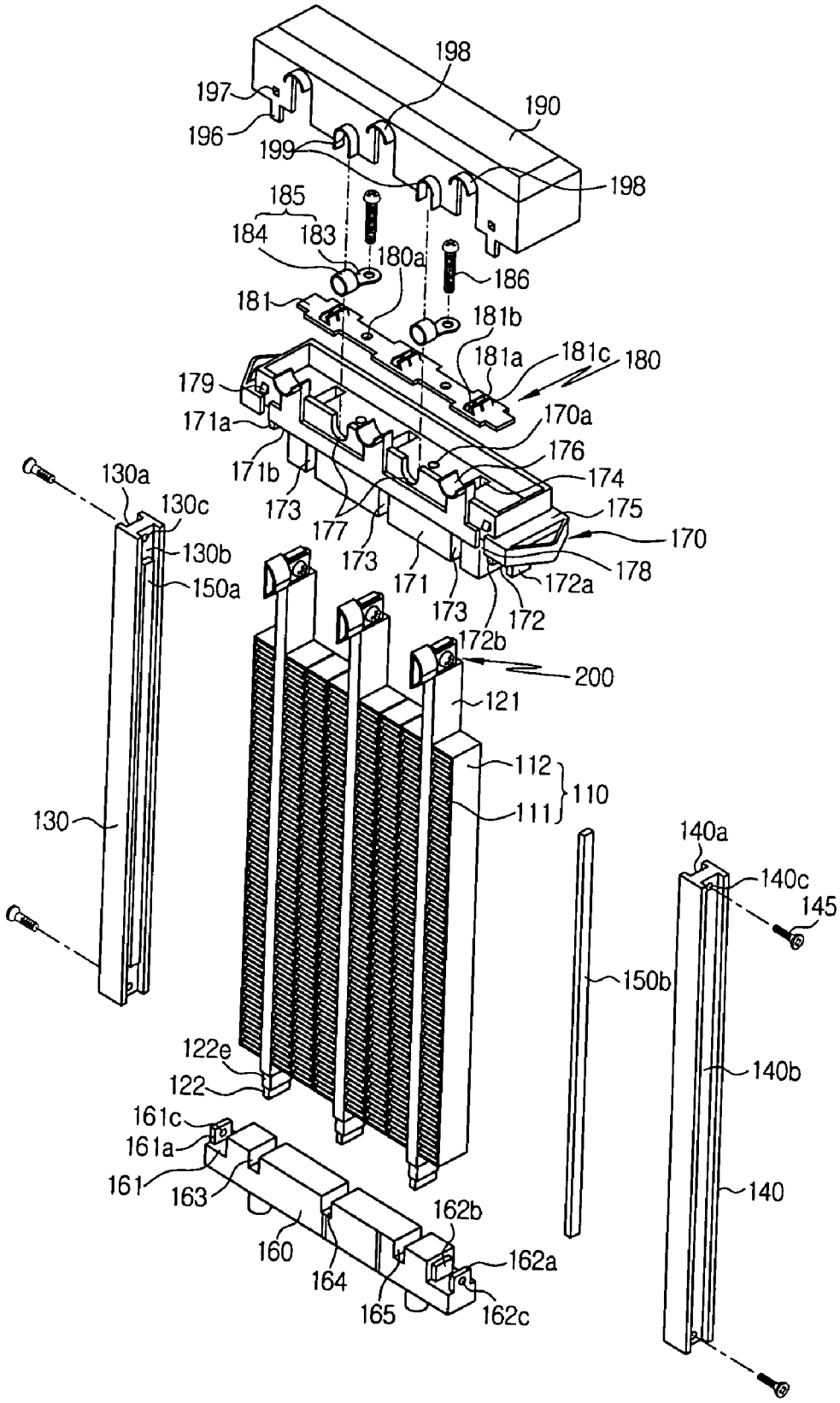
FIG. 23 is an exploded perspective view of an electric heater according to a third preferred embodiment of the present invention.
Figure 24:
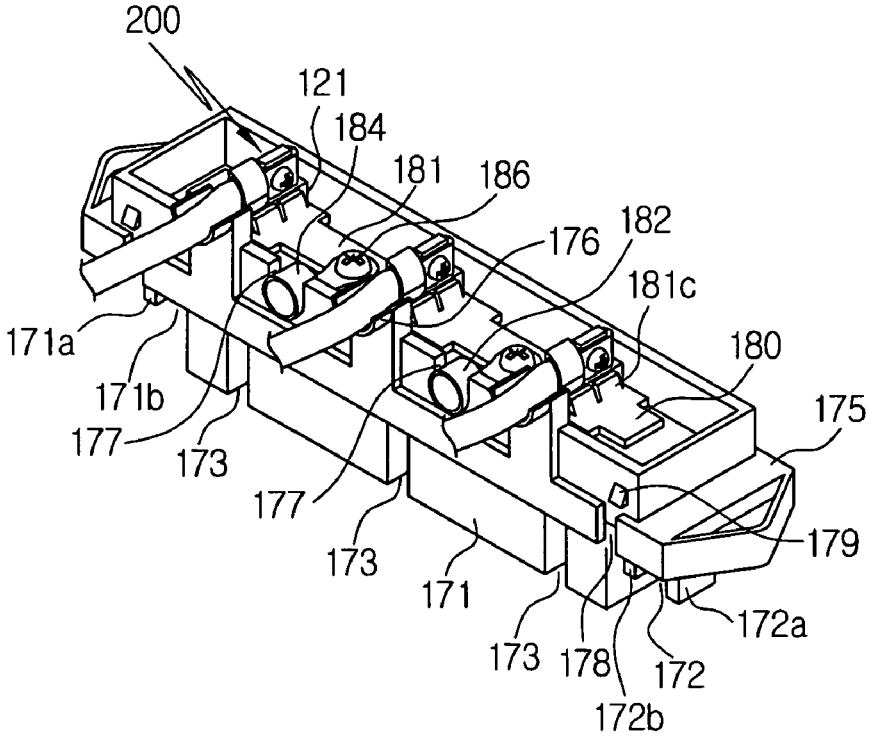
FIG. 24 is a partially perspective view showing a state where a common terminal plate, the flat tube and the first wiring part are assembled to the upper surface of the second cap of FIG. 23.
Figure 25:
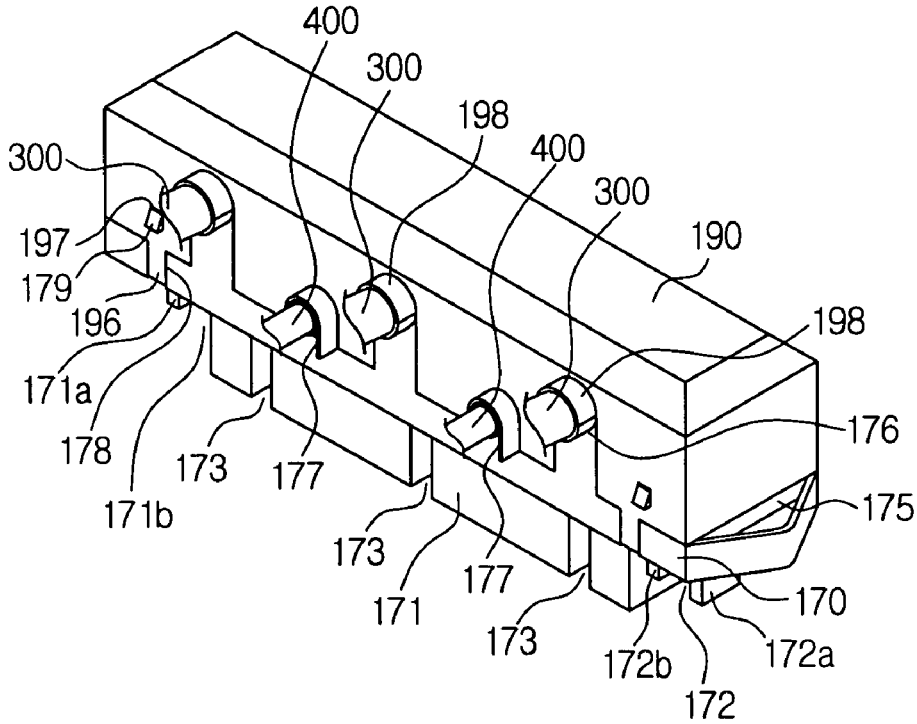
FIG. 25 is a perspective view showing a state where the cover is coupled with the second cap of FIG. 23.

FIG. 6 is a front view of an electric heater according to a second preferred embodiment of the present invention, FIG. 7 is an exploded perspective view of the electric heater according to the second preferred embodiment, FIG. 8 is an exploded perspective view of heating means installed on the electric heater of the second preferred embodiment together with a first preferred embodiment of a first wiring part, FIG. 9 is a perspective view of the first preferred embodiment of the first wiring part, which is an enlarged perspective view taken along the line of 'A' of FIG. 8, FIG. 10 is an enlarged perspective view taken along the line of 'B' of FIG. 8, FIG. 11 is a sectional view showing an assembled state of the lower end part of the electric heater according to the second preferred embodiment, FIG. 12 is an exploded perspective view showing an assembled state of the upper end part of the electric heater according to the second preferred embodiment, FIG. 13 is a perspective view showing a state where a cover is coupled with a second cap of the electric heater according to the second preferred embodiment, FIG. 14 is a partially perspective view showing a state where first and second wirings are installed in a state where the second cap and the cover of the electric heater of the second preferred embodiment are assembled with each other, FIG. 15 is an exploded perspective view of heating means of the electric heater which has foreign inflow preventing means, FIG. 16 is a partially sectional view of an assembled state of the lower end part of the electric heater having the foreign inflow preventing means, FIG. 17 is an exploded perspective view of the heating means to which the second preferred embodiment of the first wiring part is applied, FIG. 18 is a sectional view taken along the line of "A—A" of FIG. 17, FIG. 19 is a sectional view taken along the line of "B—B" of FIG. 17, FIG. 20 is an exploded perspective view of the heating means to which the third preferred embodiment of the first wiring part is applied, FIG. 21 is an exploded perspective view of the heating means to which the fourth preferred embodiment of the first wiring part is applied;

FIG. 22 is an exploded perspective view of the heating means to which the fifth preferred embodiment of the first wiring part is applied, FIG. 23 is an exploded perspective view of an electric heater according to a third preferred embodiment of the present invention, FIG. 24 is a partially perspective view showing a state where a common terminal plate, the flat tube and the first wiring part are assembled to the upper surface of the second cap of FIG. 23, and FIG. 25 is a perspective view showing a state where the cover is coupled with the second cap of FIG. 23.

An electric heater according to the second preferred embodiment of the present invention includes: a plurality of radiation members 110, each having a radiation fin 111 and a radiation fin supporting plate 112 surrounding the radiation fin 111 and formed integrally with the radiation fin 111 by brazing; a plurality of flat tubes 121 arranged between the radiation members 110 and having heating means 120 therein for generating heat when electric power is supplied; first and second support frames 130 and 140 oppositely arranged at sides of the outermost radiation members 110 for supporting and fixing the radiation members 110 and the flat tubes 121; and first and second caps 160 and 170 for supporting both end portions of the first and second support frames 130 and 140 and both end portions of the flat tubes 121.

The heating means 120 includes a guide plate 122 made of insulating material and having a plurality of through-holes 122*a* formed at fixed intervals, an electrode plate 123 made of conductive material and located at a side surface of the guide plate 122, a plurality of PTC elements 124 respectively inserted into the through-holes 122*a* of the guide plate 122, being in contact with a side surface of the electrode plate 123 and generating heat when electric power is supplied, and an insulating film 125 located on the other side surface of the electrode plate 123.

The electrode plate 123 according to the second preferred embodiment is different from the electrode plate 23 according to the first preferred embodiment in that first wire connection part 126, 200 or 270 is connected to an end portion thereof in a longitudinal direction and in a vertical direction of the heating means 120 or the flat tube 121 for connecting a first wire 300.

As shown in FIG. 9, in the first embodiment of the first wire connection part 126, the first wire connection part 126 includes: a body part 126*a* connected to a side surface of the electrode plate 123 and being in surface contact with the side surface of the electrode plate 123 in such a way as to be connected to the upper end portion of the electrode plate 123 via coupling means such as a bolt 126*f* and a nut 126*g*, a pair of support walls 126*c* and 126*d* oppositely bended on both sides of the body part 126*a* for supporting the electrode plate 123, and a compression part 126*b* rolled in the form of a ring and formed on an end portion of the body part 126*a* at right angles to the longitudinal direction of the flat tube 121 for compressing the first wire 300.

Unexplained reference numeral 126*e* designates a coupling hole corresponding to the coupling hole 123*a* of the electrode plate 123.

Meanwhile, as shown in FIGS. 17, 18 and 19 showing the second preferred embodiment of the first wire connection part, the first wire connection part 200 includes a body part 201, a pair of pressing pieces 202 oppositely bended on both side walls of an end of the body part 201 for compressing the first wire 300, a guide piece 203 having an insertion space (S) formed by bending the other end of the body part 201 toward the pressing piece 202 for inserting the electrode plate 123 thereinto, fixing means for fixing the electrode plate 123 inserted into the insertion space (S) between the body part 201 and the guide piece 203, and a movement preventing portion 205 formed by bending a side wall of the other end of the body part 201.

The movement preventing portion 205 is in surface contact with the end portion of the electrode plate 123 inserted into the insertion space (S) and serves to prevent movement even though the car is vibrated.

Here, unexplained reference numeral 203*a* designates an insertion hole formed by perforating the guide piece 203 for inserting the bolt of the fixing means 204, 201*a* designates an insertion hole formed by perforating the body part 201 for inserting the bolt of the fixing means 204, and 201*b* designates a guide portion protruding from the body part 201 to the outside for guiding the bolt inserted into the insertion hole 201*a*.

Here, of course, a screw part may be formed on the inner circumference of the guide portion 201*b* to be screwed with the bolt.

As shown in FIGS. 20 and 21, in the third and fourth embodiments of the first wire connection part 126, the first wire connection part 126 includes a body part 126*a*, a pair of support walls 126*c* and 126*d* oppositely bended on both sides of the body part 126*a* for supporting the electrode plate 123, a compression part 126*b* rolled in the form of a ring and formed integrally with an end portion of the body part 126*a* for compressing the first wire 300, and fixing means for fixing the body part 126*a* and the electrode 123.

Here, the support walls 126*c* and 126*d* support both side walls of the electrode plate 123, and so, serve to prevent movement of the electrode plate 123 even though the car is vibrated.

As the fixing means, in FIG. 20, a rivet is used, and in FIG. 21, a spot welding is applied to fix the body part 126*a* and the electrode 123.

Finally, as shown in FIG. 22, in the fifth preferred embodiment of the first wire connection part 270, the first wire connection part 270 is a compression part rolled in the form of a ring and extending integrally from an end portion of the electrode plate 123 for compressing the first wire.

Till now, various preferred embodiments of the first wire connection part according to the present invention have been described.

Meanwhile, as shown in FIG. 10, a side surface of the guide plate 122 includes a concaved receiving portion 122*b* formed long in a longitudinal direction of the guide plate 22 for receiving and fixing a side surface of the electrode plate 123 in the longitudinal direction, and a protrusion 122*c* formed on an end portion of the receiving portion 122*b* and inserted into an insertion hole 123*b* formed on the other end portion of the electrode plate 123.

Furthermore, the guide plate 122 having the protrusion 122*c* has a support portion 122*d* of a predetermined thickness protruding from the lower end portion thereof in a horizontal direction for supporting the lower end portion of the insulating film 25 contacting with the electrode plate 123.

The width (W1) of the receiving portion 122*b* is similar to the width (W2) of the electrode plate 123.

As shown in FIG. 7, such guide plate 122 is longer than the flat tube 121, and inserted into the flat tube 121 in a state where the support portion 122*d* of the guide plate 122 protrudes from the upper end portion of the flat tube 121.

The electrode plate 123, like the electrode plate 23 of the first preferred embodiment, is longer than the flat tube 121, and inserted into the flat tube 121 in such a way that the end portion of the electrode plate 123 protrudes from the inner space of the flat tube 121.

Thereby, the first wire connection part 126 connected to the upper end portion of the electrode plate 123 is exposed from the flat tube 121.

As described in the first preferred embodiment, the electrode plate 123 serves as the positive terminal by connecting the first wire 300 connected to the positive pole of the power source of the car with the compression part 126*b* of the first wire connection part 126 connected to the upper end portion of the electrode plate 123, and the other components excluding the electrode plate 123 all serve as the negative terminal, and so, additional electrode plate having the negative polarity which is used in the prior arts is not needed.

In the same way, the heating means 120 mounted inside the flat tube 121 is closely fixed to the flat tube 121 by compressing the outer surfaces of the flat tube 121.

Therefore, the present invention can increase heating value of the heating means 120 and heat transfer efficiency from the heating means 120 to the flat tube 121, improve heat contact with the adjacent radiation fins 111, and prevent the external shock and introduction of foreign inflows, thereby increasing safety and reliability.

The present invention includes means for preventing introduction of foreign inflows from the outside. As shown in FIGS. 15 and 16, the guide plate 122 includes foreign inflow preventing means 122*e* located on the lower end portion thereof, inserted into the first cap 160 and closely contacting with the lower end portion of the flat tube 121.

The foreign inflow preventing means 122*e* is in the form of a ring which has the same section as the flat tube 121, and is fit on the outer surface of the lower end portion of the guide plate 122.

The present invention can prevent introduction of the foreign inflows such as fluid into the flat tube 121, thereby preventing damages of the flat tube 121 and other components mounted inside the flat tube 121.

Here, the foreign inflow preventing means 122*e* serves to support the lower end portion of the insulating film 125 contacting with the electrode plate 123 by its thickness.

The first and second support frames 130 and 140 oppositely mounted on both side surfaces of the outermost radiation members 110 are in the form of an 'I' shape having guide holes 130*a*, 130*b*, 140*a* and 140*b* formed on both side surfaces thereof in the longitudinal direction. Unexplained reference numerals 140*a* and 140*b* designate heat insulation members.

Meanwhile, the first cap 160 includes first holes 161 and 162 respectively having a pair of first guide portions 161*a*, 161*b*, 162*a* and 162*b* oppositely protruding from both side walls thereof and coupled with the guide holes 130*a*, 130*b*, 140*a* and 140*b* of the lower end portions of the first and second support frames 130 and 140. The lower end portions of the first and second support frames 130 and 140 are respectively inserted into the first holes 161 and 162.

The first cap 160 further includes a plurality of second holes 163, 164 and 165 formed between the first holes 161 and 162 formed on both sides of the first cap 160 for inserting the lower end portions of the plural flat tubes 121 thereinto.

Furthermore, as shown in FIG. 11, the second holes 163, 164 and 165 respectively include third holes 163*a*, 164*a* and 165*a* formed on the lower end thereof for respectively inserting the support portion 122*d* of the guide plates 122 protruding from the lower end portions of the flat tubes 121 in order to firmly fix the lower end portions of the plural flat tubes 121 without movement.

The third holes 163*a*, 164*a* and 165*a* are narrower than the second holes 163, 164 and 165.

The lower end portions of the first and second support frames 130 and 140 inserted into the first holes 161 and 162 along the first guide portions 161*a*, 161*b*, 162*a* and 162*b* of the first cap 160 are fixed with the first cap 160 by coupling them with coupling means such as screws through coupling holes 130*c* and 140*c* formed on the lower end portions of the first and second support frames 130 and 140 and coupling holes 161*c* and 162*c* formed on the outermost guide portions 161*a* and 162*a*.

Moreover, the second cap 170 serves to fix the upper end portions of the first and second support frames 130 and 140 and the plural heating means 120.

The second cap 170, like the first cap 160, includes: first holes 171*b* and 172 respectively having a pair of second guide portions 171*a*, 172*a* and 172*b* oppositely protruding from both side walls thereof, the guide portions 171, 172*a* and 172*b* being coupled with guide holes 130*a*, 130*b*, 140*a* and 140*b* formed on the upper end portions of the first and second support frames 130 and 140; a protrusion part 171 formed between the first holes 171*b* and 172 and having a plurality of through-holes 173 formed at predetermined intervals; and a plate body 175 formed integrally with the protrusion part 171 and having a plurality of openings 174 communicating with the through-holes 173 for passing the upper end portions of the plural heating means 120.

Here, the upper end portions of the first and second support frames 130 and 140, like the lower end portions of the first and second support frames 130 and 140, are detachably fixed with the second cap 170 by coupling them with coupling means such as screws through coupling holes 130*c* and 140*c* formed on the upper end portions of the first and second support frames 130 and 140 and coupling holes (not shown) formed on the outermost guide portions 171*a* and 172*a* of the protrusion part 171.

As shown in FIG. 12, the plate body 175 of the second cap 170 has a support plate 176 protruding from the upper surface thereof toward a cover 190 which will be described later, and the support plate 176 has a first insertion hole 177 formed on the central portion thereof for inserting the first wire 300 therein and second insertion holes 178*a* and 178*b* formed at right and left sides of the first insertion hole 177 for inserting the second wire 400 with different polarity from the first wire 300.

FIGS.7 and 12 show only one first insertion hole 177, but the number of the first insertion hole 177 is not restricted.

The first and second caps 160 and 170 are made of insulating material to keep an electrically insulated state from the radiation member 110 and the heating means 120.

Meanwhile, as shown in FIGS. 7 and 12, a common terminal plate 180 made of conductive metal material is located on the upper portion of the second cap 170. The common terminal plate 180 is electrically connected to the plural heating means 120 respectively passing through the openings 174 of the second cap 170 to supply electric power.

The common terminal plate 180 includes a tube insertion part 181 of a straight form having a plurality of insertion holes 181*a* for inserting the upper end portions of the plural flat tubes 121 thereinto, a bended portion 182 extending from a side of the tube insertion part 181 in the longitudinal direction of the flat tube 121 and bended at right angles, and a second wire connection part 185 for connecting the second wire 400 having different polarity from the first wire 300 to the bended portion 182 at right angles to the longitudinal direction of the flat tube 121.

According to the structure of the common terminal plate 180, when the flat tubes 121 passing the openings 174 of the second cap 170 pass the insertion holes 181*a* of the tube insertion part 181, the first wire 300 connected to the positive terminal of the power source of the car can be connected to the first wire connection parts 126 connected to the upper end portions of the electrode plates 123 located inside the plural flat tubes 121 at right angles to the longitudinal direction of the flat tubes 121.

As shown in FIG. 7, the second wire connection part 185 includes a joining part 183 combined with the bended portion 182 of the common terminal plate 180 in surface contact state, and a connection part 184 of a rectangular shape formed integrally with the upper end of the joining part 183 at right angles to the longitudinal direction of the flat tube 121 for inserting and connecting the second wire.

The joining part 183 of the second wire connection part 185 and the bended portion 182 can be combined with each other by inserting and fixing coupling means such as a bolt into a coupling hole 183*a* formed on the joining part 183 and a coupling hole 182*a* formed on the bended portion 182.

Meanwhile, the second wire connection part 185 can have a structure shown in FIG. 23 besides the structure shown in FIGS. 7 and 12.

That is, the second wire connection part 185 may include a joining part 183 surface-contacting with the upper surface of the common terminal plate 180, and a connection part 184 protruding from an end portion of the joining part 183 and connected with the second wire 400.

The second wire connection part 185 shown in FIG. 23 does not have the bended portion 182 of the second wire connection part 185 shown in FIGS. 7 and 12, and so, can simplify the shape of the common terminal plate 180, and reduce the height of the cover 190 as low as the height of the bended portion 182 since the joining part 183 is in the surface contact with the common terminal plate 180.

Meanwhile, like the structure of the common terminal plate 80 according to the first preferred embodiment, the tube insertion part 181 of the common terminal plate 180 includes a pair of compression pieces 181*b* and 181*c* inclinedly protruding from both sides of the insertion holes 181*a* in the opposite direction from each other.

In the above state, the first wire 300 can be connected to the first wire connection part 126 connected to the upper end portion of the electrode plate 123, which protrudes from the inside of the flat tube 121, at right angles to the longitudinal direction of the flat tube 121.

As described above, by the first and second wire connection parts 126 and 185 having the above structures, this embodiment of the present invention can simply connect the positive and negative wires connected to the power source of the car to the electric heater at right angles to the longitudinal direction of the flat tube, and so, solve the problem of the prior arts that the wires are uprightly connected to the terminal of the electric heater in a state where the wires are bended somewhat.

Meanwhile, the present invention includes the cover 190 for protecting the common terminal plate 180 from the outside.

The cover 190 includes an internal space 190*a* for receiving the common terminal plate 180, and hooks 191 formed on both sides thereof to be detachably fixed to the second cap 170 and coupled with elastic held portions 179 protruding from both sides of the plate body 175 of the second cap 170.

The cover 190 further includes first stepped portions 192 formed on right and left sides of the upper portion of the internal space 190*a* and stepped from the outer surface of the cover 190 for supporting the lower surface of the support plate 176 of the second cap 170.

Furthermore, the cover 190 further includes a second stepped portion 194 formed on a cut portion 193 formed inside the internal space 190*a* of the central portion of the cover 190 for receiving both side protrusion pieces of the first insertion hole 177 of the second cap 170 and supporting the lower surface of the lower surfaces of the protrusion pieces.

As shown in FIGS. 23 to 25, the present invention includes wire movement preventing means for preventing movement one of the first and second wires 300 and 400.

The wire movement preventing means is located on the second cap 170 and the cover 190, and prevents movement of one of the first and second wires 300 and 400 by matching the second cap 160 and the cover 190.

The wire movement preventing means includes lower seating portions 176 and 176*a* formed on the upper edge portion of the second cap 170 for seating the lower surface of one of the first and second wires 300 and 400, and upper seating portions 198 and 199 formed on the lower edge portion of the cover 190 for seating the upper surface of the other of the first and second wires 300 and 400 seated n the lower seating portions 176 and 176*a*. The upper seating portions 198 and 199 are in contact with the lower seating portions 176 and 176*a*.

As shown in FIG. 24, after the first wire 300 and the second wire 400 are respectively and electrically connected to the first wire connection part 126 and the second wire connection part 185, the first and second wires 300 and 400 are respectively seated on the lower seating portions 176 and 176*a*.

Next, as shown in FIG. 25, when the second cap 170 and the cover 190 are matched and coupled with each other, the lower seating portion 176 and the upper seating portion 198 form a pair, and the lower seating portion 176*a* and the upper seating portion 199 form a pair, and so, they respectively form circular holes.

Thereby, the remaining parts of the first and second wires 300 and 400 are supported by the upper seating portions 198 and 199.

Therefore, since the first and second wires 300 and 400 are located inside the holes formed by matching the upper and lower seating portions 176, 176*a*, 198 and 199 and have wider area, they are not shorted from the first and second wire connection parts 126 and 185 even though the car is vibrated.

Here, the second cap 170 includes guide holes 178 formed on both sides of the front surface thereof, and hook portions 179 formed above the guide holes 178.

The cover 190 includes protrusions 196 formed downwardly from both sides of the front surface thereof to be slidably inserted into the guide holes 178, and coupling holes 197 formed above the protrusions 176 to be coupled with the hook portions 179 of the second cap 170.

When the cover 190 is slid toward the second cap 170, the protrusions 196 are guided along the guide holes 178 and the hook portions 179 are coupled with the coupling holes 197, and thereby, the cover 190 is slidably coupled with the second cap 170.

As shown in FIGS. 7, 12 and 14, the cover further includes a plurality of partitions 195 formed inside the cover 190 for comparting the first and second wire connection parts 126 and 185 in different spaces and preventing short.

As shown in FIG. 14, the partitions 195 can prevent short generated when the first and second wires are electrically connected with each other if cracks are generated from the first and second wire connection parts 126 and 185 respectively connected with the first and second wires 300 and 400 and the first and second wires 300 and 400 are separated from each other.

According to the second preferred embodiment of the present invention, the radiation member 110 and the heating means 120 can be firmly and detachably fixed by the first and second support frames 130 and 140 and the first and second caps 160 and 170.

Therefore, the present invention can prevent that the radiation member 110 and the heating means 120 are easily separated from each other due to vibration generated when the car travels, allow easy assembly and disassembly of the electric heater, and increase contact efficiency among components of the radiation member 110 and the heating means 120.

As described above, the electric heater according to the present invention can electrically and mechanically protect the heating means mounted inside the flat tube from the outside, thereby preventing damages and separation by the external force and preventing accidents and fires due to electric short generated when a great deal of conductive liquid or metal is introduced into the electric heater.

Furthermore, the flat tube having the heating means therein is compressed between the opposed support frames, and thereby, the present invention can closely contact the components of the heating means with one another without buckling of the radiation fin even though the present invention does not have the wave type spring and the internal web used in the prior arts, thereby increasing heat transfer efficiency and improving assembly efficiency and productivity by reducing the number of the components.

Moreover, only one negative wire is connected to the side portion of the common terminal plate connected with the positive electrode plate of the heating means mounted inside the flat tube, and thereby, the present invention can reduce the number of the negative terminal plate necessary for operating the electric heater, thereby reducing the number of the components and the number of assembling processes.

In addition, the flat tube having the heating means therein and the radiation fin are thermally connected with each other by bonding them, and thereby, the present invention can diffuse heat generated from the heating means to the whole area of the heater even though several heating means are heated, thereby maximizing heat transfer efficiency.

Furthermore, the radiation member has the radiation fin and the radiation fin supporting plate formed integrally with each other by brazing, and thereby, the present invention can be produced in mass quantity and minimize loss of heat transfer due to coming-off generated between the radiation fin and the heating means.

Moreover, the present invention can easily assemble the radiation member and the flat tube having the heating means therein after they are respectively produced in mass quantity, thereby simplifying the manufacturing process and increasing efficiency through modularization of the components.

Additionally, the present invention can prevent introduction of foreign inflows such as fluid into the flat tube, thereby preventing electric short between the wires located inside the cover.

In addition, the present invention can prevent short of the wires due to the external factors such as vibration of the car, and provide reliability by improving the structure of the wire connection parts for connecting the wires.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An electric heater comprising:

a plurality of radiation members, each having a radiation fin and a radiation fin supporting plate surrounding the radiation fin formed integrally with the radiation fin by brazing;

heating means having a guide plate having a plurality of through-holes, an electrode plate contacting with the guide plate, a plurality of PTC elements respectively inserted into the through-holes of the guide plate and contacting with the electrode plate for generating heat when electric power is supplied, and an insulating film contacting with a side surface of the electrode plate;

a plurality of flat tubes, each having the heating means therein, being located between the radiation members, the outer surface of the flat tube being compressed for fixing the heating means mounted therein;

first and second support frames oppositely arranged on sides of the outermost radiation members for supporting and fixing the radiation members and the flat tubes; and first and second caps for supporting both end portions of the first and second support frames and both end portions of the flat tubes.

2. An electric heater according to claim 1, wherein the flat tube is bonded with the radiation member by coating an adhesive on the outer surface of the flat tube.

3. An electric heater according to claim 1, further comprising a common terminal plate located on the upper surface of the second cap, the common terminal plate having a tube insertion part for inserting a side end portion of the flat tube having the electrode plate electrically connected with a first wire and a second wire connection part for connecting a second wire having different polarity from the first wire, the tube insertion part electrically contacting with the flat tube.

4. An electric heater according to claim 3, wherein the tube insertion part includes an insertion hole for inserting a side end portion of the flat tube thereinto, and compression pieces protruding from both inner surfaces of the insertion hole in the opposite direction for compressing the outer sides of the flat tube.

5. An electric heater according to claim 3, further comprising a first wire connection part located on the upper end portion of the electrode plate and connected with the first wire formed at right angles to a longitudinal direction of the flat tube.

6. An electric heater according to claim 5, wherein the first wire connection part includes:

a body part;

a pair of pressing pieces oppositely bended on both side walls of an end of the body part for pressing the first wire;

a guide piece formed by bending the other end of the body part toward the pressing pieces and having an insertion space for inserting the electrode plate thereinto;

fixing means for fixing the electrode plate inserted into the insertion space between the body part and the guide pieces; and a movement preventing portion formed by bending a side wall of the other end of the body part.

7. An electric heater according to claim 5, wherein the first wire connection part includes:

a body part;

a pair of support walls oppositely bended on both side walls of the body part for supporting the electrode plate;

a compression part formed integrally with an end portion of the body part and rolled in the form of a ring for compressing the first wire; and fixing means for fixing the body part and the electrode plate.

8. An electric heater according to claim 5, wherein the first wire connection part is a compression part extending integrally from an end portion of the electrode plate and rolled in the form of a ring for compressing the first wire.

9. An electric heater according to claim 3, wherein the second wire connection part includes:

a joining part being in surface contact with the upper surface of the common terminal plate; and a connection part protruding from an end portion of the joining part and connected with the second wire.

10. An electric heater according to claim 3, wherein a cover is mounted on the common terminal plate and coupled with the second cap for protecting the common terminal plate.

11. An electric heater according to claim 10, further comprising wire movement preventing means mounted on the second cap and the cover for preventing movement of one of the first and second wires by matching the second cap with the cover.

12. An electric heater according to claim 11, wherein the wire movement preventing means includes:

lower seating portions for seating the lower surface of one of the first and second wires on the upper edge of the second cap; and upper seating portions for seating the upper surface of the other of the first and second wires on the lower edge of the cover, the upper seating portions contacting with the lower seating portions.

13. An electric heater according to claims 10, wherein the cover includes a plurality of partitions formed inside the cover for comparting the first and second wire connection parts in different spaces and preventing short.

14. An electric heater according to claim 1, further comprising heat insulation members respectively mounted between the first support frame and the outermost radiation member and between the second support frame and the outermost radiation member.

15. An electric heater according to claim 1, wherein the guide plate includes a receiving part formed on a side surface thereof in a longitudinal direction of the guide plate for receiving and fixing a side surface of the electrode plate in the longitudinal direction.

16. An electric heater according to claim 15, wherein the receiving part of the guide plate includes a protrusion inserted into an insertion hole formed on the lower end portion of the electrode plate.

17. An electric heater according to claim 15, wherein the guide plate includes a support portion of a predetermined thickness protruding form the lower portion of the receiving part for supporting the lower end portion of the insulating film contacting with the electrode plate.

18. An electric heater according to claim 1, wherein the guide plate includes foreign inflow preventing means located on the lower end portion thereof, the foreign inflow preventing means closely contacting with the lower end of the flat tube and being inserted into the first cap.

19. An electric heater according to claim 18, wherein the foreign inflow preventing means is in the form of a ring having the same section as the flat tube, and fit on the outer surface of the lower end portion of the guide plate.

* * * * *